US007959151B2

(12) United States Patent
Fukube

(10) Patent No.: US 7,959,151 B2
(45) Date of Patent: Jun. 14, 2011

(54) IMAGE FORMING APPARATUS AND RECORDING MEDIUM CONVEYING DEVICE INCLUDED IN THE IMAGE FORMING APPARATUS

(75) Inventor: Noriaki Fukube, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 377 days.

(21) Appl. No.: 11/987,292

(22) Filed: Nov. 29, 2007

(65) Prior Publication Data

US 2008/0122166 A1 May 29, 2008

(30) Foreign Application Priority Data

Nov. 29, 2006 (JP) ..... 2006-322060

(51) Int. Cl.
*B65H 7/02* (2006.01)

(52) U.S. Cl. ..... 271/258.01; 271/227; 271/261; 271/265.01; 271/259

(58) Field of Classification Search ..... 271/227, 271/228, 265.01, 265.02, 259, 258.01, 261, 271/263
See application file for complete search history.

(56) References Cited

U.S. PATENT DOCUMENTS 4,559,451 A * 12/1985 Curl ..... 250/559.36
4,623,975 A * 11/1986 Kagami ..... 356/638
4,723,072 A * 2/1988 Naruse ..... 235/454
5,120,977 A * 6/1992 Dragon et al. ..... 250/559.37
5,443,257 A * 8/1995 Sakamori ..... 271/228
5,751,841 A * 5/1998 Leong et al. ..... 382/137
7,131,539 B2 * 11/2006 Mukai ..... 209/534
7,385,782 B2 * 6/2008 Seo et al. ..... 360/96.51
7,410,317 B2 * 8/2008 Noda et al. ..... 400/709
7,424,942 B2 * 9/2008 Voser ..... 194/206
7,631,743 B2 * 12/2009 Takai et al. ..... 194/206

FOREIGN PATENT DOCUMENTS

JP 62-205948 9/1987
JP 02249837 A * 10/1990
JP 05069993 A * 3/1993
JP 08-171266 7/1996
JP 08212417 A * 8/1996
JP 09-096992 4/1997
JP 09-139798 5/1997

(Continued)

OTHER PUBLICATIONS

Japanese Office Action dated Mar. 23, 2011.

*Primary Examiner* — Stefanos Karmis
*Assistant Examiner* — Luis A Gonzalez
(74) *Attorney, Agent, or Firm* — Harness, Dickey & Pierce, P.L.C.

(57) ABSTRACT

An image forming apparatus conveying a recording medium through a sheet conveying path may include a recording medium conveying device, and includes an edge position detector to detect a position of a side edge of a recording medium along a width direction perpendicular to a sheet travel direction of the recording medium in the sheet conveying path, and an edge position recognizer to recognize, based on detection results obtained by the edge position detector, the position of the side edge at multiple detection positions of the recording medium in the sheet travel direction of the recording medium. The multiple detection positions includes a detection position located within a dog ear region in the vicinity of either a leading edge or a trailing edge of the recording medium in the sheet travel direction.

19 Claims, 12 Drawing Sheets

FOREIGN PATENT DOCUMENTS

| | | |
|---|---|---|
| JP | 10-288876 | 10/1998 |
| JP | 2000-247496 | 9/2000 |
| JP | 2000-255834 | 9/2000 |
| JP | 2004-262584 | 9/2004 |
| JP | 2005-173237 | 6/2005 |
| JP | 2005-352703 | 12/2005 |
| JP | 2006-222707 | 8/2006 |
| JP | 2007-106588 | 4/2007 |

* cited by examiner

IMAGE FORMING APPARATUS AND RECORDING MEDIUM CONVEYING DEVICE INCLUDED IN THE IMAGE FORMING APPARATUS

CROSS-REFERENCE TO RELATED APPLICATION

The present patent application claims priority under 35 U.S.C. §119 from Japanese Patent Application No. 2006-322060 filed on Nov. 29, 2006, the contents and disclosure of which are hereby incorporated by reference herein in their entirety.

BACKGROUND

1. Field

Example embodiments of the present patent application generally relate to an image forming apparatus and a recording medium conveying device included in the image forming apparatus, for example, to an image forming apparatus and a recording medium conveying device used in the image forming apparatus, in which a dog ear formed on a recording medium and/or skew of a recording medium may effectively be detected during a transfer operation of the recording medium.

2. Discussion of the Related Art

Related-art image forming apparatuses and recording medium conveying devices form an image on a recording medium or transfer a recording medium according to a condition of the recording medium conveyed therein.

Such a related-art image forming apparatus includes a configuration in which a transfer deviation sensor detects a position of the edge of a recording medium or recording paper across a sheet width direction perpendicular to a sheet travel direction of the recording medium or recording paper. This sensor detects the position of the edge of a recording medium across the sheet width direction and obtains an amount of sheet transfer deviation of a recording medium so that the related-art image forming apparatus may form an image at a correct position on the recording medium, based on the detection results obtained as described above.

Such a related-art image forming apparatus may alternatively employ a configuration in which a deviation sensor detects at least two positions of the edge of a recording medium and a controller determines whether the recording medium has skew or not by referring to the detected positions. Based on the above-described determination results, the controller displays an error message. The related-art image forming apparatus with this configuration determines whether a recording medium is skewed or not, and adjusts an image according to the degree of skew of the recording medium to form the image at an accurate position on the recording medium. By so doing, even when a recording medium is conveyed obliquely in the sheet travel direction, an image may be properly formed at an appropriate position on the recording medium, thereby avoiding production of a defect copy. In addition, depending on the degree of skew of a recording medium, the controller causes an operation panel or other display unit to display an error message to notify a user of the failure and/or causes a transfer operation of the recording medium to stop. With the above-described operations, a paper jam caused by the skew of the recording medium may be prevented.

Another drawback causing defects or damages during an image forming operation with respect to a recording medium is that a corner or corners of the leading or trailing edge or both edges of a recording medium may be folded down during the transfer operation. Such a folded corner of a recording medium or recording paper is called and referred hereinafter to as a "dog ear."

Compared with a recording medium having no dog ear, a recording medium having a dog ear may easily be caught in a material forming a conveying path of the recording medium, and therefore, the recording medium may easily get jammed in the conveying path. Depending on a user, the dog ear itself is regarded as a failure when found on a recording medium with an image formed thereon.

A demand for avoiding failures due to dog ear(s) of a recording medium is increasing as well as a demand for higher accuracy in image forming position. For example, when a printout page has a dog ear or dog ears when binding the printouts as a book, the entire book may be regarded as a defective product.

Such a recording medium or printout having a dog ear therein has been removed by a user manually or by hand prior to the binding operation or the entire book or set of printouts including such a recording medium has been printed again. This may impose a great load and loss to a user or manufacturer.

Further, when an extremely large dog ear has been made, a paper jam may occur in an image forming apparatus. When a paper jam occurs due to such a large dog ear, the recording medium may be bent or folded in a complex manner. Therefore, a load on a user may increase when removing such a jammed recording medium from the image forming apparatus.

Furthermore, if a user finds it difficult to remove the jammed paper by himself or herself, the user may contact a maintenance person. Accordingly, a downtime period of the image forming apparatus increases, which reduces the production of the image forming apparatus.

Accordingly, the above-described actions may cause a waste of time and unnecessary load on a user, as well as a waste of paper resources and energy to drive the image forming apparatus.

SUMMARY

In light of the foregoing, the inventors of the present patent application detect whether a dog ear is formed on a recording medium during a transfer operation thereof.

In light of the foregoing, the inventors of the present patent application provide an image forming apparatus, a recording medium conveying device included in the image forming apparatus that may eliminate the drawbacks of the above-described techniques, specifically, by detecting a dog ear and/or skew with respect to a recording medium during a transfer operation thereof.

One or more example embodiments of the present patent application have been made, taking the above-described circumstances into consideration.

At least one example embodiment of the present patent application provides an image forming apparatus conveying a recording medium through a sheet conveying path to an image forming position and forming an image on the recording medium, the image forming apparatus including an edge position detector to detect a position of a side edge of a recording medium along a width direction perpendicular to a sheet travel direction of the recording medium in the sheet conveying path, and an edge position recognizer to recognize, based on detection results obtained by the edge position detector, the position of the side edge at multiple detection positions of the recording medium in the sheet travel direction of the recording medium. The multiple detection positions included a detection position located within a dog ear region in the vicinity of either a leading edge or a trailing edge of the recording medium in the sheet travel direction.

The above-described image forming apparatus may further include a position deviation determining unit to determine whether or not an amount of variation on results of the side edges detected at two detection positions is greater than a given amount. The two detection positions among the multiple detection positions may be either of a first combination of one detection position located within the dog ear region and one detection position located outside the dog ear region or a second combination of two detection positions located within the dog ear region. The image forming operation with respect to the recording medium may be controlled according to results obtained by the position deviation determining unit.

At least one of the two detection positions may be located outside the dog ear region, and the position deviation determining unit may determine whether an amount of variation on results of the side edges detected at two detection positions corresponding to the first combination is greater than the given amount.

A first operation may be performed when the position deviation determining unit determines the amount of variation is equal to or smaller than the given amount, and a second operation may be performed when the position deviation determining unit determines the amount of variation is greater than the given amount.

The first operation may include a notification operation to notify a user of the results determined by the position deviation determining unit and the second operation may include a stop operation to stop a transfer operation of the recording medium.

The first operation may include a continuation operation to continue the image forming operation and the second operation may include a stop operation to stop a transfer operation of the recording medium.

The first operation may include a continuation operation to continue the image forming operation and the second operation may include a notification operation to notify a user of the results determined by the position deviation determining unit.

At least one example embodiment of the present patent application provides an image forming apparatus conveying a recording medium through a sheet conveying path to an image forming position and forming an image on the recording medium, the image forming apparatus including an edge position detector to detect a position of a side edge of a recording medium along a width direction perpendicular to a sheet travel direction of the recording medium in the a sheet conveying path, an edge position recognizer to recognize, based on detection results obtained by the edge position detector, the position of the side edge of the recording medium at three or more detection positions of the recording medium in the sheet travel direction of the recording medium, an inclination calculator to calculate an inclination of either a line connecting two or more points on side edges of the three or more detection positions or an edge-to-edge line obtained by approximating the side edge in the width direction of the two or more points, and an inclination deviation determining unit to determine whether inclinations of two edge-to-edge lines obtained based on the two or more points on the side edges of the recording medium in the width direction, the edge-to-edge lines having different combinations of the two or more points of the side edges in the width direction.

The image forming operation with respect to the recording medium may be controlled based on results obtained by a position deviation determining unit.

The multiple detection positions may include a detection position located within a dog ear region in the vicinity of either a leading edge or a trailing edge in the sheet travel direction of the recording medium.

At least one example embodiment of the present patent application provides a recording medium conveying device including an edge position detector to detect a position of a side edge of a recording medium along a width direction perpendicular to a sheet travel direction of the recording medium in a sheet conveying path, an edge position recognizer to recognize, based on detection results obtained by the edge position detector, the position of the side edge at multiple detection positions of the recording medium in the sheet travel direction of the recording medium, an inclination calculator to calculate an inclination of either a line connecting two or more points on side edges of three or more detection positions or an edge-to-edge line obtained by approximating the side edge in the width direction of the two or more points, an inclination deviation determining unit to determine whether inclinations of two edge-to-edge lines obtained based on the two or more points on the side edges of the recording medium in the width direction, the edge-to-edge lines having different combinations of the two or more points of the side edges in the width direction, and a sheet accumulating unit to accumulate the recording medium prior to the transfer operation.

BRIEF DESCRIPTION OF THE DRAWINGS

The accompanying drawings are intended to depict example embodiments of the present patent application and should not be interpreted to limit the scope thereof. The accompanying drawings are not to be considered as drawn to scale unless explicitly noted.

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXAMPLE EMBODIMENTS

Figure 1:
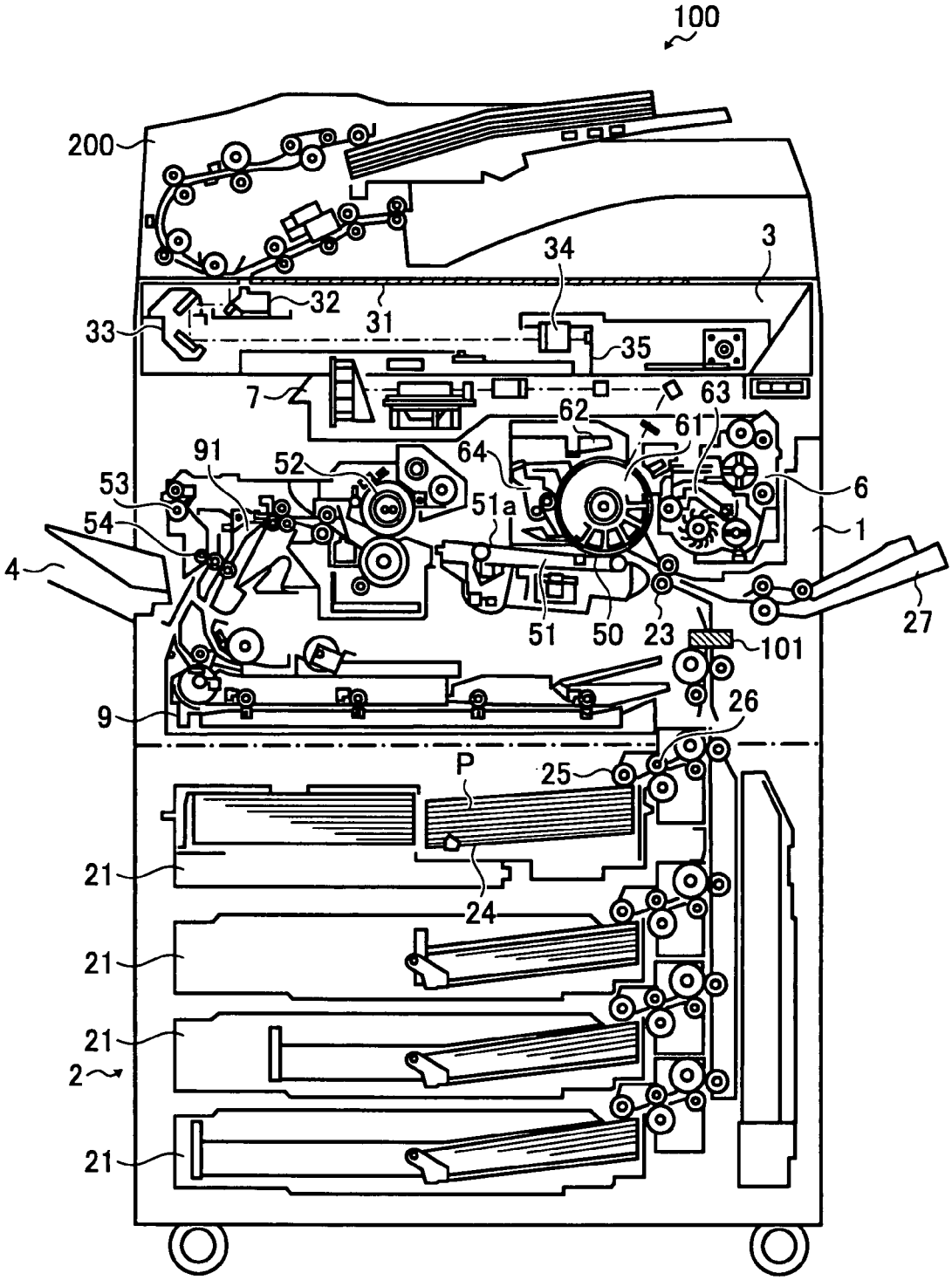
FIG. 1 is a cross-sectional view of a schematic configuration of an image forming apparatus, according to an example embodiment of the present patent application, including a recording medium conveying device, according to an example embodiment of the present patent application.

It will be understood that if an element or layer is referred to as being "on", "against", "connected to" or "coupled to" another element or layer, then it may be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" may encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present patent application.

The terminology used herein is for the purpose of describing example embodiments only and is not intended to be limiting of the present patent application. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, example embodiments of the present patent application are described.

Now, example embodiments of the present patent application are described in detail below with reference to the accompanying drawings.

Descriptions are given, with reference to the accompanying drawings, of examples, example embodiments, modification of example embodiments, etc., of an image forming apparatus according to the present patent application, and a recording medium conveying device, according to the present patent application, included in the image forming apparatus according to the present patent application. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of example embodiments of the present patent application.

The present patent application includes a technique applicable to any image forming apparatus. For example, the technique of the present patent application is implemented in the most effective manner in an electrophotographic image forming apparatus including a recording medium conveying device.

Referring to FIG. 1, a schematic structure of an image forming apparatus according to an example embodiment of the present patent application is described.

In the example embodiment, an image forming apparatus corresponds to a copier 100.

As an alternative to the copier 100, an image forming apparatus may be a facsimile machine, printer, and multi-functional image forming apparatus including at least two functions of copier, facsimile machine, and so forth.

The copier 100 of FIG. 1 includes a main body 1, a sheet feeding device 2, an image reading device 3, and/or a sheet discharging device 4.

The main body 1 of FIG. 1 is disposed at a substantially center part of the copier 100.

The sheet feeding device 2 of FIG. 1 is disposed below the main body 1 and serves as a sheet accumulating unit. The sheet feeding device 2 includes multiple sheet feeding mechanisms or sections, each having a sheet feeding tray 21.

The image reading device 3 of FIG. 1, which may be a scanner, is disposed above the main body 1 to optically read original documents placed on a contact glass 31 of the main body 1 or fed from an automatic document feeder or ADF 200. Details of the image reading device 3 will be described later.

The sheet discharging unit 4 of FIG. 1 is disposed at a left side of the main body 1 in FIG. 1. The sheet discharging unit 4 receives and stacks a recording medium or recording paper P discharged from the main body 1.

The main body 1 includes an image forming unit 6 including a photoconductive drum 61 and other image forming components disposed around the photoconductive drum 61. The image forming components are, for example, a charging unit 62 for charging a surface of the photoconductive drum 61, an optical writing unit 7 for emitting a laser light beam of image data onto the surface of the photoconductive drum 61 to form an electrostatic latent image on the surface thereof, a developing unit 63 for developing the electrostatic latent image formed on the photoconductive drum 61 to a visible toner image, and/or a cleaning unit 64 for removing and collecting residual toner remaining on the surface of the photoconductive drum 61 after a transfer of the toner image.

The main body 1 further includes a transfer device 51 disposed below the image forming unit 6. The transfer device 51 includes a transfer belt 51*a* that conveys a recording paper P fed from the sheet feeding device 2. In synchronization with a movement of the recording paper P conveyed by the transfer belt 51*a*, the toner image is transferred from the photoconductive drum 61 onto the recording paper P at an image forming position formed between the transfer belt 51*a* and the photoconductive drum 61, which is referred to as a transfer nip contact 50.

A fixing unit 52 is also provided in the main body 1, to the left side of the transfer device 51 in FIG. 1. The fixing unit 52 fixes the toner image to the recording paper P by applying heat and pressure when the recording paper P passes through a pair of rollers in the fixing unit 52.

After passing through the fixing unit 52, the recording paper P may be discharged by a sheet discharging roller 53 to the sheet discharging unit 4.

The copier 100 performs an image forming operation in a simplex printing mode as described above. In addition, the copier 100 may have a function to form images on both sides of a recording medium.

When the copier 100 performs an image forming operation in a duplex printing mode, the recording paper P passing after the fixing unit 52 may be guided by a path selector 91 to a reverse unit 9. The recording paper P may be reversed in the reverse unit 9 and conveyed to a pair of registration rollers 23, at which skew of the recording paper P may be corrected before the image forming operation for the back side of the recording paper P is performed.

The sheet feeding device 2 includes multiple sheet feeding trays 21, in each of which accommodating unused or new recording papers P. Each of the multiple sheet feeding trays 21 include a base plate 24, a pickup roller 25, and a sheet feeding roller 26.

When feeding a recording papers P, the base plate 24 that is rotatably supported in each sheet feeding tray 21 elevates to a position at which the pickup roller 25 contacts a recording paper P placed on top of a stack of recording papers P in the sheet feeding tray 21. By respective rotations of the pickup roller 25 and the sheet feeding roller 26, the top recording paper P is fed from the sheet feeding tray 21 and conveyed toward the pair of registration rollers 23 serving as a registration part. Alternative to the sheet feeding device 2, a recording paper P may be fed from a manual sheet feeding tray 21. In example embodiments, the recording paper P is directed to the pair of registration rollers 23 from the manual sheet feeding tray 21.

The pair of registration rollers 23 is caused to stop its rotation to convey the recording paper P for controlling a timing to resume the rotation thereof. With this action, the toner image formed on the surface of the photoconductive drum 61 is caused to synchronize with a movement of the transfer belt 51*a* carrying the recording paper P thereon. That is, the above-described adjustment causes the toner image on the photoconductive drum 61 and the leading edge of the recording paper P to form a given positional relation at the transfer nip contact 50. Accordingly, a transfer timing of the recording paper P to be conveyed to the transfer nip contact 50 may be controlled.

As previously described, the image reading device 3 may read or scan an image formed on an original document placed on the contact glass 31. The image reading device 3 further includes a first moving member 32, a second moving member 33, a lens 34, and a charge-coupled device or CCD 35.

The first and second moving members 32 and 33 may include a light source and mirrors. The first and second moving members 32 and 33 may move along a lower surface of the contact glass 31 reciprocally in a horizontal direction to read the image formed on an original document placed on the contact glass 31, then transmit image data of the read image to the CCD 35 disposed behind the lens 34.

The CCD 35 receives the image data as image signal. The image data is then digitalized by an image processing unit, not shown.

Based on the image signal processed by the above-described image processing operation, the optical writing unit 7 provided in the main body 1 may cause a laser diode LD, not shown, to be emitted to irradiate the surface of the photoconductive drum 61 so that an electrostatic latent image may be formed thereon. The optical signal transmitted from the laser diode LD reaches the photoconductive drum 61 via a known polygon mirror and known lenses.

As previously described, the ADF 200 may be disposed above the image reading device 3 to automatically feed and transfer an original document to be read by the image reading device 3.

The copier 100 serves as an image forming apparatus including functions of a digital copying machine that reads image data of an original document, and digitalizes then prints the image data on a recording paper. The copier 100 further includes functions of a facsimile machine in which a controller, not shown, communicates with a local machine for transmitting and receiving image data of an original document, functions of a printer in which the controller causes to print image data on a recording paper, and so forth. The copier 100 may be set as a digital copier through an operation unit from which a user may optionally set parameters of the copier 100. In addition, any image formed on a recording paper through any function of the image forming apparatus may be output to the sheet discharging unit 4.

When the recording paper P is guided by the path selector 91 to the reverse unit 9 and is continuously discharged via a reverse roller 54 and the sheet discharging roller 53 to the sheet discharging unit 4, the recording paper P is discharged to the sheet discharging unit 4 in a face down manner. That is, when multiple original documents are fed, the recording papers P having the images according to the original documents may be output in the original order of the original documents. Therefore, the copier 100 may not need to perform a page sorting operation of the recording papers P.

The recording paper P travels in the copier 100 along a sheet conveying path, through which the recording paper P passes from the pickup roller 25 and the sheet feeding roller 26 of the sheet feeding tray 21 to the sheet discharging unit 4.

The size of the recording paper P ranges generally from an A3-size paper sheet to a postcard. Therefore, positional accuracy in each size may need to be achieved.

The copier 100 further includes a sheet width sensor 101 along the sheet conveying path. The sheet width sensor 101 is an optical sensor generally called as a line sensor, and serves as a positional detection unit to detect the size of a recording paper P fed from the sheet feeding device 2. The sheet width sensor 101 detects a position of side edge of a recording paper P across a sheet width direction or a direction perpendicular to the sheet travel direction of the recording paper P.

The sheet width sensor 101 is provided upstream of the pair of registration rollers 23 in the copier 100 of FIG. 1 in the sheet travel direction of the recording paper P to detect the side edge of the recording paper P across the sheet width direction thereof in the sheet travel direction. Then, based on the detection results, the toner image may be formed at an accurate position on the recording paper P.

The sheet width sensor 101 includes a transmission-type sheet width sensor 101*t* and a reflection-type sheet width sensor 101*r*.

Referring to FIGS. 2 through 5, detailed descriptions are given of the transmission-type sheet width sensor 101*t* and the reflection-type sheet width sensor 101*r*.

Figure 2:
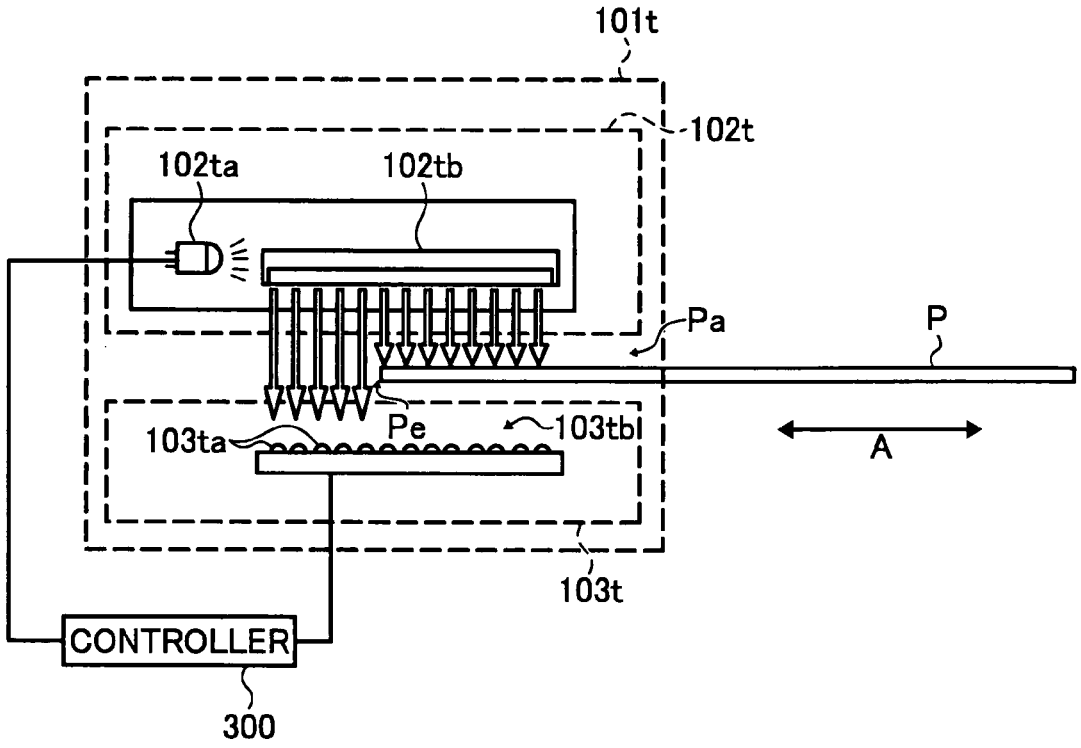
FIG. 2 is a cross-sectional view of a schematic configuration of a transmission-type sheet width sensor of the recording medium conveying device of FIG. 1, according to an example embodiment of the present patent application.

FIG. 2 shows a schematic structure of the transmission-type sheet width sensor 101*t*.

In FIG. 2, the transmission-type sheet width sensor 101*t* includes a light emitting part 102*t* above a sheet conveying path Pa through which the recording paper P passes and a light receiving part 103*t* below the sheet conveying path Pa.

The light receiving part 103*t* includes multiple light receiving elements 103*ta* and a light receiving element array 103*tb* having the multiple light receiving elements 103*ta* aligned thereon in the sheet width direction indicated by arrow A in FIG. 2, which is a direction perpendicular to the sheet travel direction of the recording paper P.

The light emitting part 102*t* includes a light emitting element 102*ta* and a lighting guide 102*tb* or a guide opening array. The lighting guide 102*tb* guides light, which is emitted by the light emitting element 102*ta*, downwardly or vertically from top to bottom of each light receiving element 103*ta*.

The light receiving elements 103*ta* forming the light receiving element array 103*tb* of the light receiving part 103*t* are aligned at equally spaced intervals in the sheet width direction.

A controller 300 is connected to the light emitting element 102*ta* to transmit a light emitting signal thereto and the light receiving elements 103*ta* to receive a signal indicating each output result therefrom. After the transmission-type sheet width sensor 101*t* has detected the side edge of a recording paper P across the sheet width direction, the controller 300 that serves as an end position recognizer to recognize the position of the side edge Pe at multiple detection positions of the recording paper P in the sheet travel direction, based on the detection results of the transmission-type sheet width sensor 101*t*. The controller 300 transmits the light emitting signal to the light emitting element 102*ta*, causes the light emitting element 102*ta* to emit, receives the signal indicating each output result of the light receiving elements 103*ta* from the light receiving part 103*t*, and recognizes the side edge Pe of the recording paper P based on the output results thereof.

Figure 3:
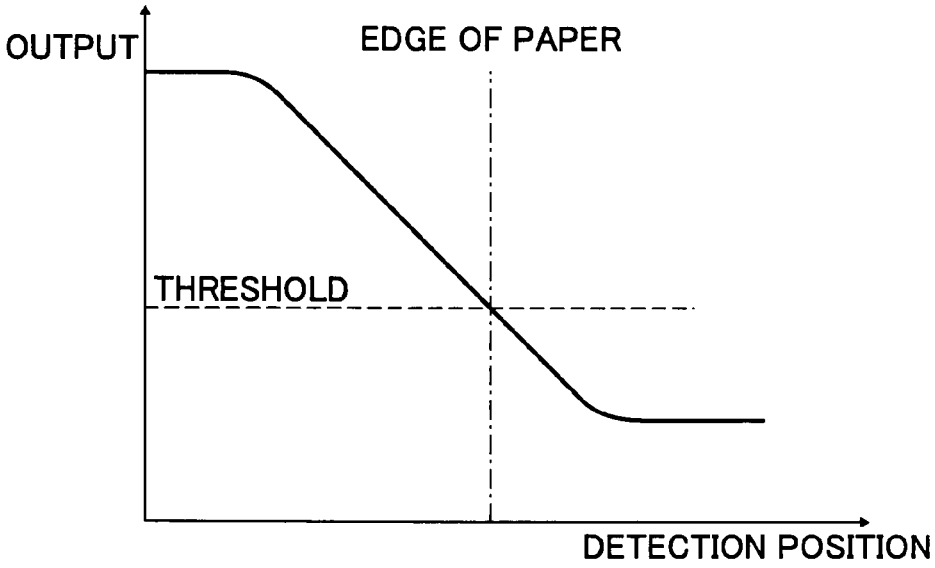
FIG. 3 is an example graph showing detection results obtained by the transmission-type sheet width sensor of FIG. 2.

FIG. 3 is a graph showing detection results obtained at one timing by the transmission-type sheet width sensor 101*t* of FIG. 2.

The graph of FIG. 3 shows the results in a linear shape based on the plotted detection results of each of the light receiving elements 103*ta*. That is, the graph of FIG. 3 shows schematic or rough detection results of the light receiving elements 103*ta*.

The "DETECTION POSITION" along the horizontal axis of the graph of FIG. 3 indicates a position of each of the light receiving elements 103*ta* in the sheet width direction, and the "OUTPUT" along the vertical axis of the graph of FIG. 3 indicates an output value or an amount of light received by the light receiving elements 103*ta* aligned at the detection position. The detection position of the light receiving element 103*ta* closer to the right side of the horizontal axis of the graph of FIG. 3 is located closer to the center or medial side of the recording paper P in the sheet width direction, and the detection position of the light receiving element 103*ta* closer to the left side of the horizontal axis of the graph of FIG. 3 is located far from the center or medial side of the recording paper P in the sheet width direction.

The output values of the light receiving elements 103*ta* obtained by the transmission-type sheet width sensor 101*t* may depend on respective positions of the recording paper P opposite to the light receiving elements 103*ta*. For example, when passing through the sheet conveying path Pa, the recording paper P blocks the appropriate number or amount of light paths from which the light emitting part 102*t* is emitted to the light receiving part 103*t*. When a greater number of light paths are blocked by the recording paper P passing through the sheet conveying path Pa, the output values of the light receiving elements 103*ta* of the light receiving part 103*t* may be smaller. By contrast, when a smaller number of light paths are blocked when the recording paper P passes through the sheet conveying path Pa, the output values of the light receiving elements 103*ta* of the light receiving part 103*t* may be greater.

However, it is not that a light receiving element 103*ta* receives only a light beam emitted from a position directly facing the lighting guide 103*tb* or a position exactly opposite to the light receiving element 103*ta*. In other words, not only the light receiving elements 103*ta* disposed on the left side of the side edge Pe of the recording paper P in FIG. 2 but also the light receiving elements 103*ta* disposed on the right side of the side edge Pe of the recording paper P in FIG. 2 receive the light beams emitted from the light emitting part 102*t*. The output values of the light receiving elements 103*ta* gradually and sequentially change the amounts thereof in the vicinity of the side edge Pe as shown in the graph of FIG. 3. The reasons of the gradual and sequential change of the output values are described below.

As shown in FIG. 2, the transmission-type sheet width sensor 101*t* has a given distance between the light emitting part 102*t* and the recording paper P in the sheet conveying path Pa and a given distance between the light receiving part 103*t* and the recording paper P in the sheet conveying path Pa. Therefore, when the light emitting part 102*t* emits light through light paths toward the light receiving part 103*t*, some light beams passing through corresponding light paths just outside or on the left side of the side edge Pe of the recording paper P may come around the outside of the side edge Pe of the recording paper P. Then, the light beams coming around the side edge Pe of the recording paper P may enter the light receiving elements 103*ta* disposed just inside or on the immediate right side of the side edge Pe of the recording paper P in the sheet width direction. In addition, the light receiving element 103*ta* disposed on the outer side of and away from the side edge Pe of the recording paper P in the sheet width direction may receive a greater amount of light than the light receiving element 103*ta* disposed on the immediately outside and closer to the side edge Pe of the recording paper P. It is because the light receiving element 103*ta* disposed away from the side edge Pe may receive a light beam coming in from a direct angle of the light emitting part 102*t* as well as another light beam coming in from an oblique angle thereof. Therefore, the light receiving part 103*ta* disposed away from the side edge Pe may receive a greater amount of light, which is a greater output value, than the light receiving element 103*ta* disposed in the vicinity of the side edge Pe of the recording paper P. Accordingly, the results of the output values of the light receiving elements 103*ta* of the transmission-type sheet width sensor 101*t* may sequentially and gradually change in the vicinity of the side edge Pe of the recording paper P, as shown in the graph in FIG. 3.

To detect the side edge Pe of the recording paper P passing through the sheet conveying path Pa by using the transmission-type sheet width sensor 101*t*, it may be advantageous to previously conduct tests and obtain an output value, as a threshold value, at the detection position of the light receiving element 103*ta* disposed opposite to the side edge Pe and set the output value to the controller 300.

The controller 300 recognizes the detection position of the light receiving element 103*ta* of the transmission-type sheet width sensor 101*t*, at which the above-described output value or threshold value was obtained, as a position of the side edge Pe, and controls image forming operations performed by the main body 1 of the copier 100 with respect to the recording paper P based on the results of the recognized detection position. When the recording paper P has a positional deviation in the sheet width direction, the controller 300 causes the main body 1 of the copier 100 to adjust a toner image to be formed on the photoconductive drum 61 to a deviated position along an axial direction of the photoconductive drum 61.

Figure 4A:
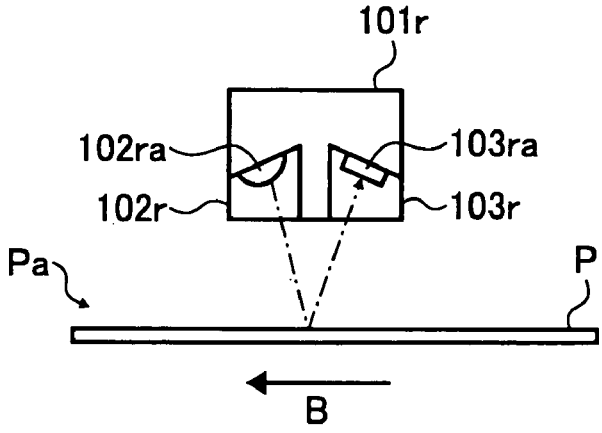
FIG. 4A is a cross-sectional view of a schematic configuration of a reflection-type sheet width sensor of the recording medium conveying device of FIG. 1, according to an example embodiment of the present patent application.
Figure 4B:
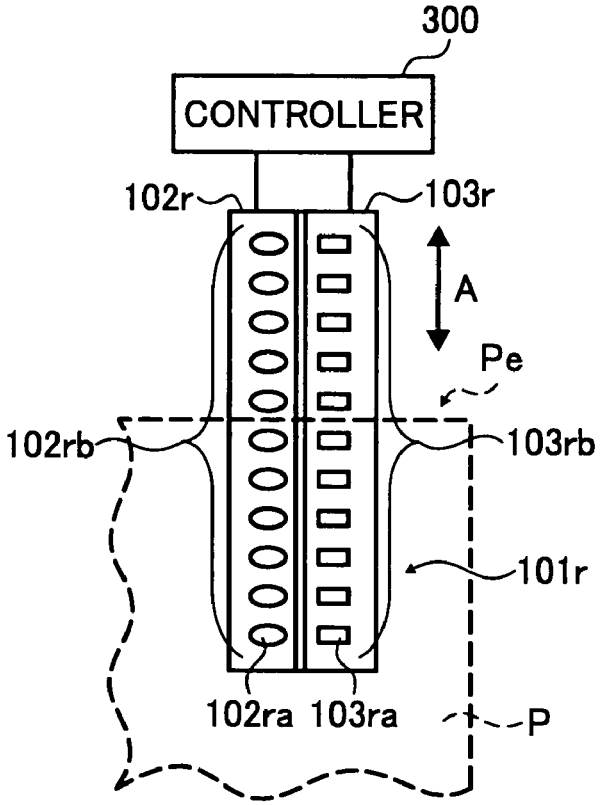
FIG. 4B is an example bottom plan view of the reflection-type sheet width sensor of FIG. 4A.

FIGS. 4A and 4B show schematic structures of the reflection-type sheet width sensor 101*r*. FIG. 4A is a cross-sectional view of the reflection-type sheet width sensor 101*r*, and FIG. 4B is a view thereof describing the bottom part thereof. Arrow B in FIG. 4A indicates a sheet travel direction of the recording paper P passing through the sheet conveying path Pa, and arrow A in FIG. 4B indicates the sheet width direction of the recording paper P.

In FIG. 4A, the reflection-type sheet width sensor 101*r* is disposed above the sheet conveying path Pa and includes a light emitting part 102*r* and a light receiving part 103*r*. As shown in FIG. 4B, the light emitting part 102*r* includes multiple light emitting elements 102*ra* aligned as a light emitting element array 102*rb* in a sheet width direction of the recording paper P. The light receiving part 103*r* includes multiple light receiving elements 103*ra* aligned as a light receiving element array 103*rb* also in a sheet width direction thereof.

The controller 300 is connected to the light emitting part 102*r* and the light receiving part 103*r*. The controller 300 may transmit a light emitting signal to the light emitting part 102*r* so that the multiple light emitting elements 102*ra* may emit light at the same time to direct respective light beams toward the corresponding light receiving elements 103*ra*. At this time, the controller 300 receives an output result signal from each of the multiple light receiving elements 103*ra* of the light receiving part 103*r*. Accordingly, based on the above-described output results, the controller 300 recognizes the side edge Pe of the recording paper P.

Figure 5:
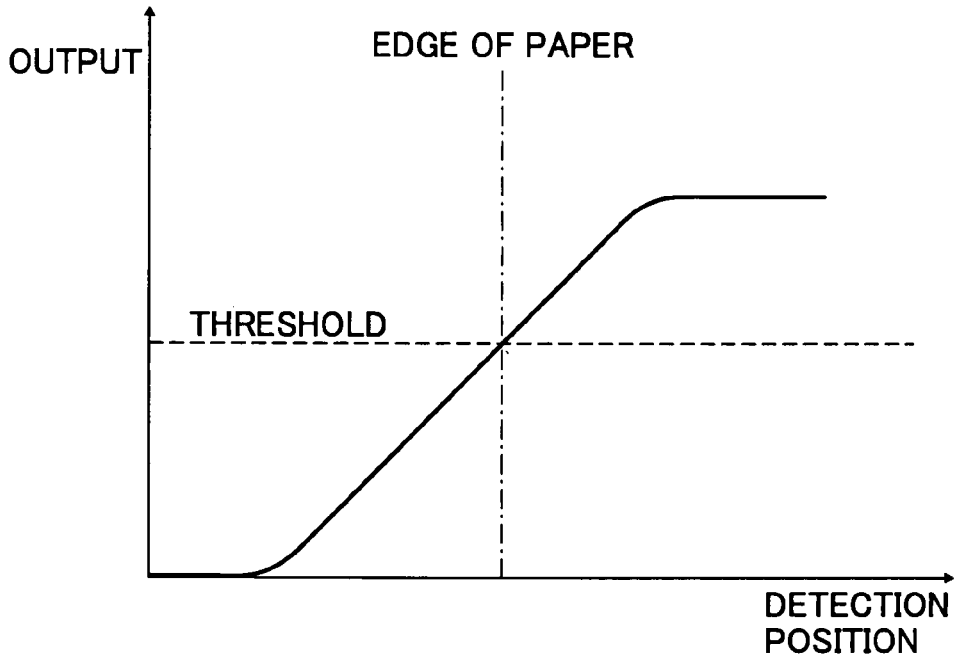
FIG. 5 is an example graph showing detection results obtained by the reflection-type sheet width sensor of FIGS. 4A and 4B.

FIG. 5 is a graph showing detection results obtained at one timing by the reflection-type sheet width sensor 101*r* of FIGS. 4A and 4B.

The graph of FIG. 5 shows the results in a linear shape based on the plotted detection results of each of the light receiving elements 103*ra*. That is, the graph of FIG. 5 shows schematic or rough detection results of the light receiving elements 103*ra*.

The "DETECTION POSITION" along the horizontal axis of the graph of FIG. 5 indicates a position of each of the light receiving elements 103*ra* in the sheet width direction, and the "OUTPUT" along the vertical axis of the graph of FIG. 5 indicates an output value or an amount of light received by the light receiving elements 103*ra* aligned at the detection position. The detection position of the light receiving element 103*ra* closer to a lower side of the horizontal axis of the graph of FIG. 5 is located closer to the center or medial side of the recording paper P in the sheet width direction, and the detection position of the light receiving element 103*ra* closer to an upper side of the horizontal axis of the graph of FIG. 5 is located far from the center or medial side of the recording paper P in the sheet width direction.

The output value of the light receiving elements 103*ra* obtained by the reflection-type sheet width sensor 101*r* may depend on respective positions of the recording paper P opposite to the light emitting elements 102*ra* and the light receiving elements 103*ra*. For example, the recording paper P reflects light beams emitted from the light emitting part 102*r* so that the reflected light or specular reflection light reflected by the recording paper P may direct toward the light receiving part 103*r* when the recording paper P passes through the sheet conveying path Pa. When a greater number of light beams are reflected by the recording paper P while the recording paper P is passing through the sheet conveying path Pa, the output values of the light receiving elements 103*ra* of the light receiving part 103*r* may be greater. By contrast, when a smaller number of light beams are reflected by the recording paper P while passing through the sheet conveying path Pa, the output values of the light receiving elements 103*ra* of the light receiving part 103*r* may be smaller.

However, it is not that a light receiving element 103*ra* receives only a reflected light beam of a light beam emitted by the light emitting element 102*ra* disposed right next to the light receiving element 103*ra*. In other words, not only the light receiving elements 103*ra* disposed on the lower side of the side edge Pe of the recording paper P in FIG. 4B but also the light receiving elements 103*ra* disposed on the upper side of the side edge Pe of the recording paper P in FIGS. 4A and 4B receive the specular reflection light beams emitted from the light emitting part 102*r* and reflected by the recording paper P. The output values from the light receiving elements 103*ra* gradually and sequentially change the amounts thereof in the vicinity of the side edge Pe as shown in the graph of FIG. 5. The reasons of the gradual and sequential change of the output values in the graph of FIG. 5 are described below.

The reflected light beam reflected on the recording paper P includes diffuse reflection light as well as specular reflection light. Therefore, when the light emitting part 102*r* emits light toward the recording paper P and the light is reflected on the recording paper P, some diffuse reflection light reflected just inside or on the lower side of the side edge Pe of the recording paper P may come in the light receiving elements 103*ra* disposed just outside or on the immediate upper side of the side edge Pe of the recording paper P in the sheet width direction.

In addition, in FIG. 4B, the light receiving element 103*ra* disposed on the lower side of and away from the side edge Pe of the recording paper P in the sheet width direction may receive a greater amount of reflected light than the light receiving element 103*ra* disposed on the immediately inside and closer to the side edge Pe of the recording paper P. It is because the light receiving element 103*ra* disposed away from the side edge Pe may receive a reflected light beam coming in from a correct angle of the light emitting part 102*r* as well as another reflected light beam come in from an incorrect or oblique angle thereof. By contrast, of the light receiving elements 103*ra* disposed on the upper side of the side edge Pe of the recording paper P in FIG. 4B, the light receiving element 103*ra* disposed closer to the side edge Pe thereof may not receive diffuse reflection light reflected at an oblique angle on the recording paper P from the side edge Pe. Therefore, the light receiving part 103*ra* disposed away from the side edge Pe may receive a greater amount of reflected light, which is a greater output value, than the light receiving element 103*ra* disposed outside but in the vicinity of the side edge Pe of the recording paper P. Accordingly, the results of the output values of the light receiving elements 103*ra* of the reflection-type sheet width sensor 101*r* may sequentially and gradually change in the vicinity of the side edge Pe, as shown in the graph in FIG. 5.

To detect the side edge Pe of the recording paper P passing through the sheet conveying path Pa by using the reflection-type sheet width sensor 101*r*, it may be advantageous to previously conduct tests and obtain an output value, as a threshold value, at the detection position of the light receiving element 103*ra* disposed opposite to the side edge Pe and set the output value to the controller 300. This is the same procedure as the edge position detection operation using the transmission-type sheet width sensor 101*t*.

The controller 300 recognizes the detection position of the light receiving element 103*ra* of the reflection-type sheet width sensor 101*r*, at which the above-described output value or threshold value was obtained, as a position of the side edge Pe, and controls image forming operations performed by the main body 1 of the copier 100 with respect to the recording paper P based on the results of the recognized position.

Figure 6:
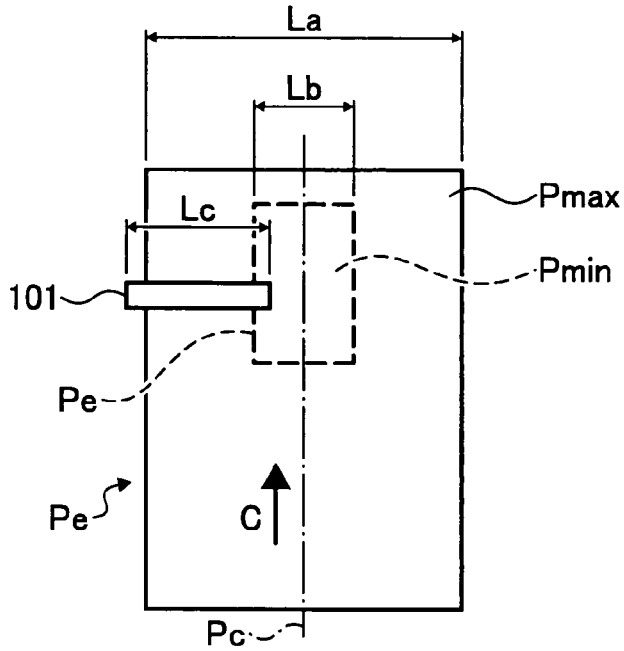
FIG. 6 is an example view showing a positional relation between a length of the sheet width sensor in a sheet width direction and sizes of applicable recording papers.

FIG. 6 shows a positional relation between a length of the sheet width sensor 101 in the sheet width direction and sizes of applicable recording papers P.

The sheet width sensor 101 may be the transmission-type sheet width sensor 101*t*, the reflection-type sheet width sensor 101*r*, or the like. The recording paper P may be an A3-size paper, a regular size paper, a postcard size, or the like. Arrow C in FIG. 6 indicates a sheet travel direction of the recording paper P.

The copier 100 includes a configuration employing a center registration in positioning the recording paper P for image forming, as shown in FIG. 6. That is, when positioning the recording paper P for image forming, a center of the recording paper P to be conveyed is registered or aligned at a center Pc in the sheet conveying path Pa so as to adjust the image forming position of the recording paper P.

As previously described, the size of the recording paper P ranges from an A3-size paper to a postcard size paper. The sheet width sensor 101 may need to detect any size of the papers in the above-described range. That is, the sheet width sensor 101 may need to detect the side edge Pe of a maximum recording paper Pmax having a maximum width length La and the side edge Pe of a minimum recording paper Pmin having a minimum width length Lb.

To detect each size of various types of the recording papers P including the maximum recording paper Pmax and the minimum recording paper Pmin, the sheet width sensor 101 may generally need to have a length greater than a ½ length of a difference between the maximum width length La of the maximum recording paper Pmax and the minimum width length Lb of the minimum recording paper Pmin. In FIG. 6, the copier 100 includes the sheet width sensor 101 having a detection width length Lc, which is greater than the half width length of the difference between the maximum width length La and the minimum width length Lb.

In the present patent application, the copier 100 may use the sheet width sensor 101 and the controller 300 shown in FIGS. 2, 4A, and 4B to detect and recognize the position of the side edge Pe. Accordingly, the copier 100 may feed back information of the position of the side edge Pe and adjust the recording paper P to a correct image forming position.

Figure 7:
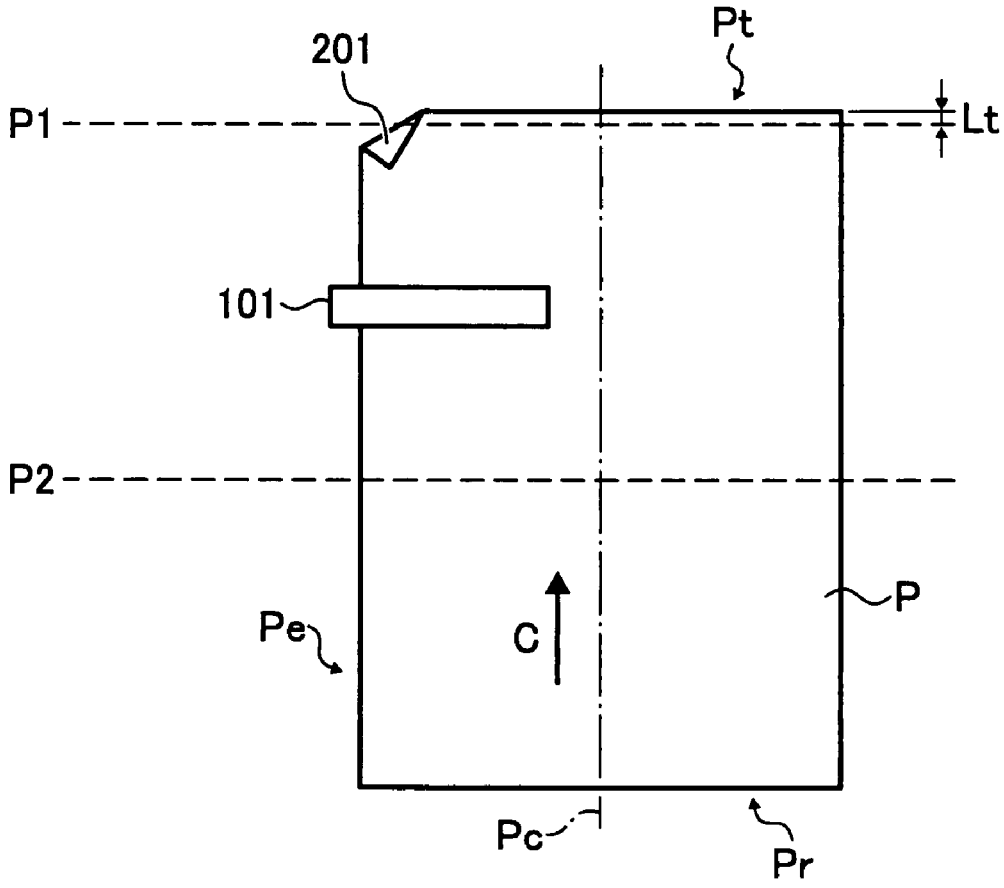
FIG. 7 is an example view of detection positions on a side edge of a recording medium detected by the sheet width sensor of the recording medium conveying device of FIG. 1, the recording medium having a dog ear at a leading edge thereof.

Next, referring to FIG. 7, a detailed description is given of detection positions to be specified for detecting the position of the side edge Pe of the recording paper P by the sheet width sensor 101, according to an example embodiment of the present patent application.

In FIG. 7, arrow C indicates a sheet travel direction of the recording paper P.

The sheet width sensor 101 may be the transmission-type sheet width direction 101*t*, the reflection-type sheet width direction 101*r*, or the like.

During a transfer operation of a recording paper P in the copier 100, a corner or corners folded down at the leading edge and/or the trailing edge of a recording paper P may sometimes be found. Such a folded corner of a recording medium or recording paper is, hereinafter, referred to as a "dog ear."

The sheet width sensor 101 detects a position of the side edge Pe of the recording paper P, at multiple detection positions in the sheet travel direction of the recording paper P. One of the multiple detection positions to detect the side edge Pe by the sheet width sensor 101 may be adjusted and specified to a first detection position P1 that is located within a dog ear region in the vicinity of a leading edge Pt of the recording paper P in the sheet travel direction. Based on the detection results obtained at the first detection position P1, the controller 300 may recognize the side edge Pe at the multiple detection positions.

The "dog ear region" corresponds to a region in which a dog ear 201 adversely affecting the sheet transfer operation is possibly formed. For example, when a dog ear failure occurs in a size or range of the dog ear 201 exceeding or greater than the dog ear region in the sheet travel direction of the recording paper P, an occurrence rate of a paper jam increases. The distance from the leading edge Pt of the recording paper P to a medial end or limit of the dog ear region on the medial side of the recording paper P depends on the size of the recording paper P.

When an image forming apparatus causes a paper jam or other failure therein even with a small dog ear, a relatively short distance from the leading edge Pt of the recording paper P to the medial end of the dog ear region may need to be set. By contrast, when an image forming apparatus causes a paper jam or other failure therein only with a large dog ear, a relatively long distance from the leading edge Pt of the recording paper P to the medial end of the dog ear region may be set. Further, when an image forming apparatus may detect even a small dog ear, it is regarded that the first detection position P1 equals to the leading edge Pt of the recording paper P, and therefore, the first detection position P1 may be set to the same position as the leading edge Pt of the recording paper P.

A position of the leading edge Pt may be detected by a leading edge sensor, not shown, disposed at a position upstream of the sheet width sensor 101 in a sheet travel direction of the recording paper P or at a position same as the sheet width sensor 101 in the sheet travel direction of the recording paper P, facing and opposite to the center Pc along the sheet conveying path Pa. The leading edge sensor may be an optical sensor that emits at a given frequency.

A timing that the leading edge Pt of the recording paper P passes the detection positions of the sheet width sensor 101 along the sheet travel direction may be detected, based on a positional relation of the leading edge sensor and the sheet width sensor 101, a passage timing of the leading edge Pt of the recording paper P at the setting position of the leading edge sensor, and a transfer speed of the recording paper P. According to the timing and the transfer speed of the recording paper P, the position of the side edge Pe of the recording paper P may be detected at the timing that the desired or optional first detection position P1 passes the detection position of the sheet width sensor 101.

Alternative to a setting of a different unit of sensor serving as the leading edge sensor, the sheet width sensor 101 may also serve as a leading edge sensor by further detecting the timing that the leading edge Pt of the recording paper P passes the detection position of the sheet width sensor 101. In example embodiments, the light emitting element 102*a* of the sheet width sensor 101 emits in a given frequency before the leading edge Pt of the recording paper P reaches the detection position of the sheet width sensor 101. According to the timing that the recording paper P is detected at the position facing or opposite to the light receiving element 103*a* based on the output results of the light receiving part 103, the timing at which the leading edge Pt of the recording paper P passes the sheet width sensor 101 may be detected.

The dog ear region of the copier 100 is set within 3 mm from the leading edge Pt of the recording paper P, and the distance Lt is set to 1 mm from the leading edge Pt of the recording paper P to the first detection position P1.

Further, one of the multiple detection positions to detect the side edge Pe by the sheet width sensor 101 may be adjusted and specified to a second detection position P2 that is located in the vicinity of a center of the recording paper P in the sheet travel direction. The detection position arranged in the vicinity of the center of the recording paper P in the sheet travel direction may receive a less adverse affect even when a dog ear 201 is produced at the leading edge Pt or the trailing edge Pr of the recording paper P in the sheet travel direction.

As shown in FIG. 7, a position of the side edge Pe of the recording paper P at which the dog ear 201 has been produced is detected and confirmed, when comparing the detection results obtained at the first detection position P1 having the dog ear 201 therein with the detection results obtained at the second detection position P2 not having the dog ear 201 therein. According to the comparison, the side edge Pe detected at the first detection position P1 resides on a more medial side in the sheet width direction of the recording paper P. Accordingly, the recording paper P having the dog ear 201 therein may be detected.

Figure 8:
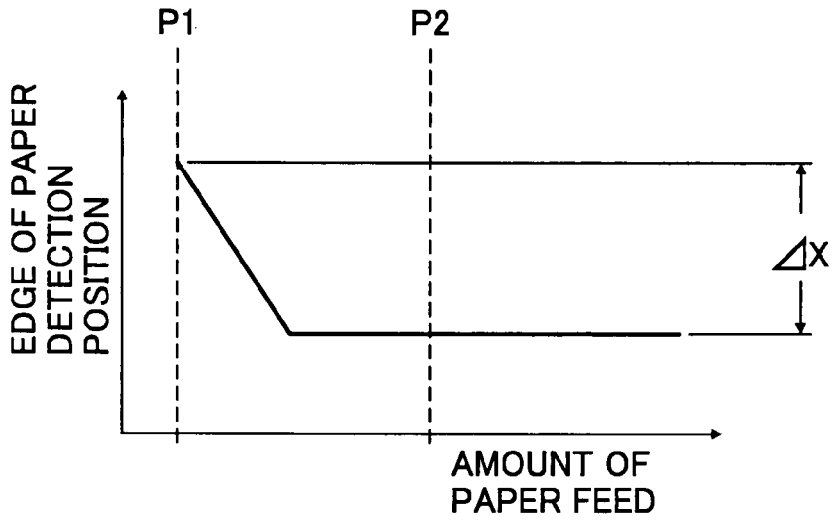
FIG. 8 is an example graph showing detection results of the side edge of the recording medium having a dog ear at the leading edge of the recording medium.

FIG. 8 is a graph showing detection results of the side edge Pe of the recording paper P having the dog ear 201 thereon. The detection results were obtained by sequentially detecting the side edge Pe of the recording paper P of FIG. 7, having the dog ear 201 in the vicinity of the leading edge Pt of the recording paper P.

The graph of FIG. 8 shows the detection results in a linear shape based on the plotted detection results of each of the light receiving elements 103*a*. That is, the graph of FIG. 8 shows schematic or rough detection results of the light receiving elements 103*a*.

The "AMOUNT OF PAPER FEED" along the horizontal axis of the graph of FIG. 8 indicates an amount of paper feed or distance from the leading edge Pt of the recording paper P along the sheet travel direction, and the "EDGE OF PAPER DETECTION POSITION" along the vertical axis thereof indicates a detection position of the side edge Pe of the recording paper P.

The edge of paper detection position closer to the upper side of the vertical axis of the graph of FIG. 8 is located closer to the center Pc (see FIG. 7) of the recording paper P in the sheet conveying path Pa, and the edge of paper detection position closer to a lower side of the vertical axis of the graph of FIG. 8 is located away from the center Pc of the recording paper P in the sheet conveying path Pa. Further, when a dog ear 201 is produced or formed at the leading edge Pt of the recording paper P, the detection results of the side edge Pe of the recording paper P may gradually and sequentially change as the amount of paper feed increases, as shown in the graph of FIG. 8.

The sheet width sensor 101 detects the position of the side edge Pe of the recording paper P, and the controller 300 recognizes the multiple detection positions of the side edge Pe along the sheet travel direction of the recording paper P. Among the multiple detection positions, the controller 300 that serves as a position deviation determining unit compares two detection positions of the side edge Pe and determines whether an amount of difference of the two detection positions exceeds a given amount. Then, the image forming operation with respect to the recording paper P is performed according to the result obtained by the controller 300 based on to the first detection position P1 as a position within the dog ear region and the second detection position P2 as a position outside the dog ear region.

At this time, an amount of variation $\Delta X$ of the detection result of the side edge Pe of the recording paper P obtained at the first detection position P1 and the detection result of the side edge Pe obtained at the second detection position P2 exceeds or is greater than a given amount, it is determined that the dog ear 201 produced on the recording paper P may need to be adjusted or the recording paper P having the dog ear 201 may be removed.

Figure 9:
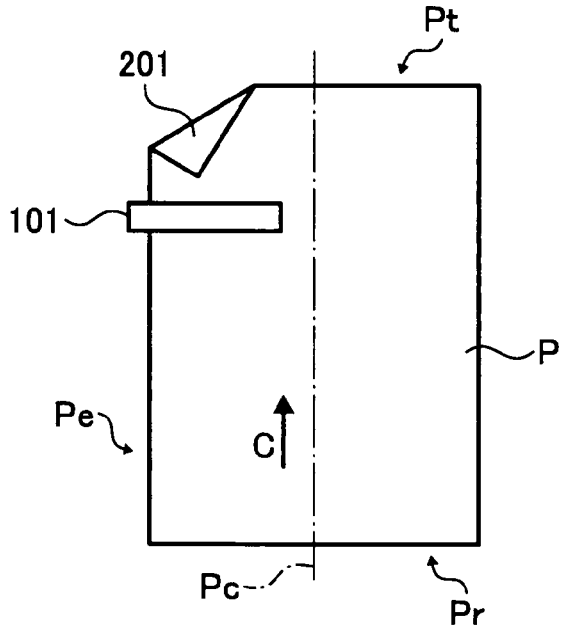
FIG. 9 is an example view of a recording medium having a large dog ear at the leading edge thereof.

Further, when the dog ear 201 produced on the recording paper P is large as shown in FIG. 9, the amount of variation $\Delta X$ may be greater than the above-described amount of variation $\Delta X$, thereby detecting that a dog ear 201 greater than the dog ear 201 shown in FIG. 7 is produced.

During a transfer operation of the recording paper P, when the size of the dog ear 201 on the recording paper P is small, less or no impact or damage may be given to the transfer operation, when compared with the recording paper P having a relatively large dog ear 201. However, when the size of the dog ear 201 is relatively large, a failure may be caused during the transfer operation of the recording paper P, which is highly possible to cause a paper jam. In such a paper jam with a large dog ear 201, the recording paper P may be bent or folded in a complex manner. Therefore, it may be difficult for a user to remove the jammed paper, and a load on the user may increase when removing the jammed recording paper P from the image forming apparatus.

Further, when removal of the jammed paper is difficult to conduct, the user may contact a maintenance person. Removal of the jammed paper may increase a period of a downtime of the image forming apparatus. This may reduce production of the image forming apparatus.

Therefore, the copier 100 may include optional operations to avoid an occurrence of a complex paper jam.

In the copier 100, when the amount of variation ΔX is equal to or smaller than, for example, 10 mm, it is determined that no problem may be caused during the transfer operation, and the transfer operation may continue. When the amount of variation ΔX is greater than 10 mm, it is determined that it is possible to cause a complex paper jam during the transfer operation, and the transfer operation for image forming may be stopped.

In above-described example embodiments of the present patent application, when the side edge Pe of the recording paper P is sequentially detected as shown in the graph of FIG. 8, the detection results of two specific detection positions may be compared to determine whether or not the amount of variation ΔX exceeds a given amount. However, alternatively, a position closest to the center Pc of the sheet conveying path Pa and a position furthest from the center Pc thereof may be selected as another option of two specific detection positions regarding the detection results of the side edge Pe from the leading edge Pt of the recording paper P to the trailing edge Pr thereof. Then, the controller 300 may determine whether or not an amount of variation ΔX between the two specific detection positions exceeds a given amount.

Figure 10:
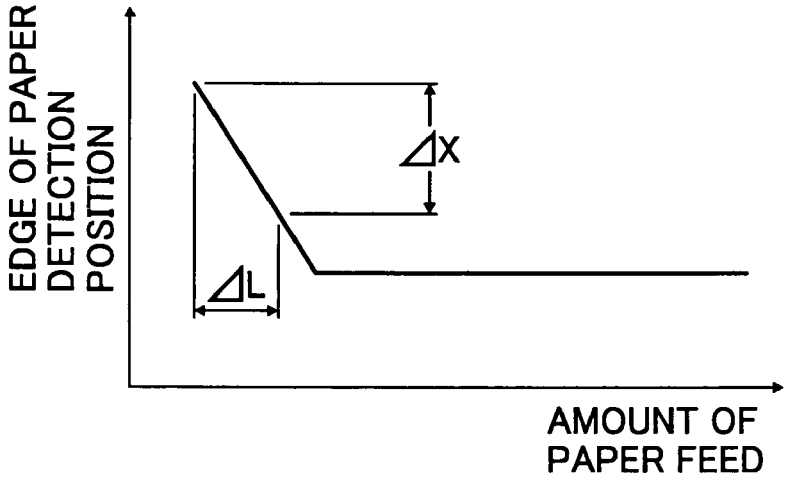
FIG. 10 is an example graph showing detection results of the dog ear within a length including the leading edge of the recording medium.

When obtaining the amount of variation ΔX, a dog ear 201 may also be detected by detecting two detection positions residing within an interval or length ΔL including the leading edge Pt, as shown in a graph of FIG. 10. In example embodiments, only a portion in a short interval or length of the entire length of the recording paper P may need to be checked. Therefore, a dog ear 201 may quickly be detected and the transfer operation may immediately be stopped in the early stage. Accordingly, an occurrence of a paper jam may further be reduced or prevented before the recording paper P having a dog ear 201 is conveyed to a downstream direction.

In example embodiments, it may be advantageous that the interval or length ΔL has a substantially same amount as a reference determination amount of a dog ear 201.

The dog ear 201 may be produced not only at a corner or corners of the leading edge Pt of the recording paper P but also at a corner or corners of the trailing edge Pr thereof.

Figure 11:
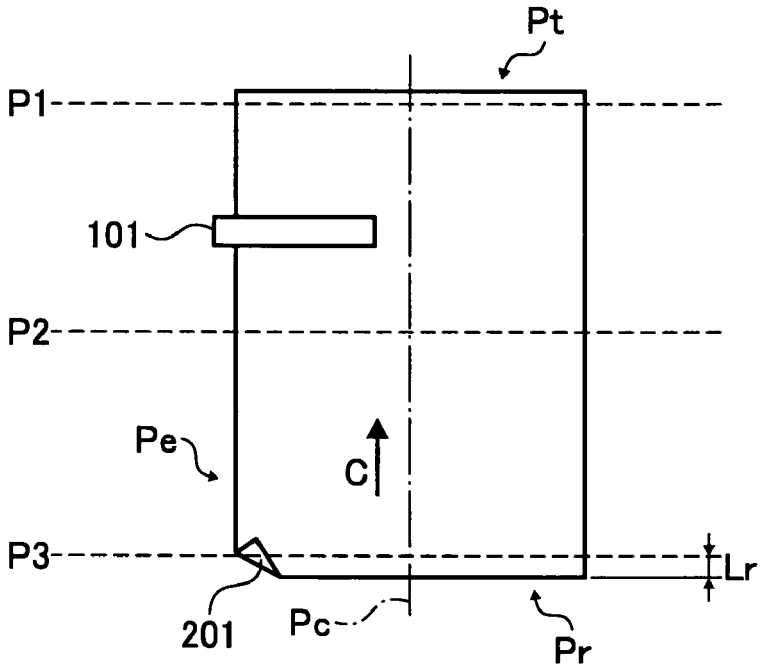
FIG. 11 is an example view of detection positions on a side edge of a recording medium detected by the sheet width sensor of the recording medium conveying device of FIG. 1, the recording medium having a dog ear at a trailing edge thereof.

Referring to FIG. 11, a description is given of another detection position of the sheet width sensor 101 to detect a dog ear 201 formed on the trailing edge Pr of the recording paper P according to an example embodiment of the present patent application.

In FIG. 11, arrow C indicates the sheet travel direction of the recording paper P.

The sheet width sensor 101 detects a position of the side edge Pe of the recording paper P, at multiple detection positions in the sheet travel direction of the recording paper P. One of the multiple detection positions to detect the side edge Pe by the sheet width sensor 101 may be adjusted and specified to a third detection position P3 that is located within a dog ear region in the vicinity of a trailing edge Pr of the recording paper P in the sheet travel direction.

The dog ear region including the third detection position P3 corresponds to a region in which a dog ear 201 adversely affecting the sheet transfer operation is possibly formed. For example, when a dog ear failure occurs in a size or range of the dog ear 201 exceeding or greater than the dog ear region in the sheet travel direction of the recording paper P, an occurrence rate of a paper jam increases. The distance from the trailing edge Pr of the recording paper P to a medial end or limit of the dog ear region depends on the size of the recording paper P.

When an image forming apparatus causes a paper jam or other failure therein even with a small dog ear 201, a relatively short distance from the trailing edge Pr of the recording paper P to the medial end or limit of the dog ear region may need to be set. By contrast, when an image forming apparatus causes a paper jam or other failure therein only with a large dog ear 201, a relatively long distance from the trailing edge Pr of the recording paper P to the medial end of the dog ear region may need to be set. Further, when an image forming apparatus may detect even a small dog ear 201, it is regarded that the third detection position P3 equals to the trailing edge Pr of the recording paper P, and therefore, the third detection position P3 may be set to the same position as the trailing edge Pr of the recording paper P.

To detect the dog ear 201 formed at the corner or corners of the trailing edge Pr of the recording paper P, the dog ear region of the copier 100 is set within 3 mm from the trailing edge Pr of the recording paper P, and a distance Lr is set to 1 mm from the trailing edge Pr of the recording paper P to the third detection position P3.

As shown in FIG. 11, when a position of the side edge Pe of the recording paper P at which the dog ear 201 has been produced is detected and confirmed, the detection results obtained at the third detection position P3 having the dog ear 201 therein is compared with the detection results obtained at the second detection position P2 not having the dog ear 201 therein. According to the above-described comparison result, it is found that the side edge Pe of the third detection position P3 resides to the medial side in the sheet width direction of the recording paper P more than the side edge Pe of the second detection position P2. Accordingly, the recording paper P having the dog ear 201 therein may be detected.

Figure 12:
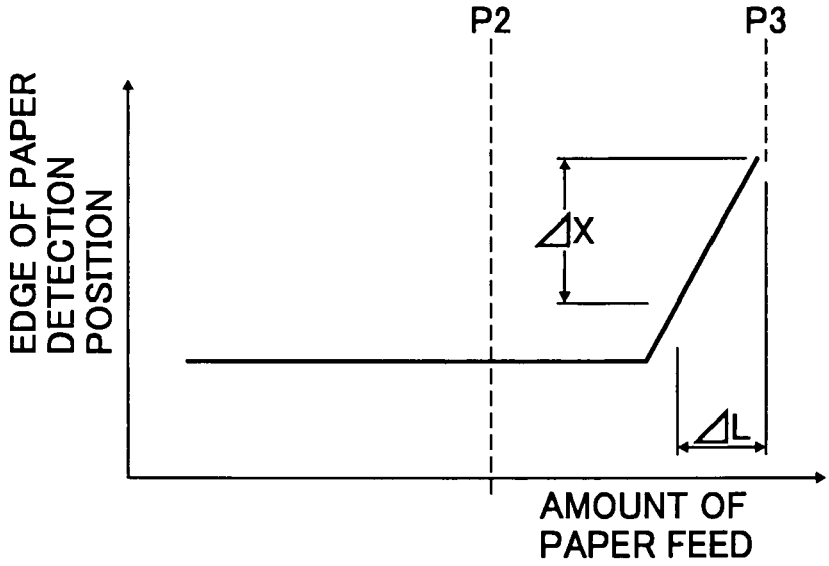
FIG. 12 is an example graph showing detection results of the dog ear within a length including the trailing edge of the recording medium.

FIG. 12 is a graph showing detection results of the side edge Pe of the recording paper P having the dog ear 201 thereon. The detection results were obtained by sequentially detecting the side edge Pe of the recording paper P of FIG. 11, having the dog ear 201 in the vicinity of the trailing edge Pr of the recording paper P.

The graph of FIG. 12 shows the detection results in a linear shape based on the plotted detection results of each of the light receiving elements 103*a*. That is, the graph of FIG. 12 shows schematic or rough detection results of the light receiving elements 103*a*.

The "AMOUNT OF PAPER FEED" along the horizontal axis of the graph of FIG. 12 indicates an amount of paper feed or distance from the trailing edge Pr of the recording paper P along the sheet travel direction, and the "EDGE OF PAPER DETECTION POSITION" along the vertical axis thereof indicates a detection position of the side edge Pe of the recording paper P.

The edge of paper detection position closer to the upper side of the vertical axis of the graph of FIG. 12 is located closer to the center Pc (see FIG. 11) of the recording paper P in the sheet conveying path Pa, and the edge of paper detection position closer to a lower side of the vertical axis of the graph of FIG. 12 is located away from the center Pc of the recording paper P in the sheet conveying path Pa. Further, when a dog ear 201 is produced or formed at the trailing edge Pr of the recording paper P, the detection results of the side edge Pe of the recording paper P may gradually and sequentially change as the amount of paper feed increases, as shown in the graph of FIG. 12.

The sheet width sensor 101 detects the position of the side edge Pe of the recording paper P, and the controller 300 recognizes the multiple detection positions of the side edge Pe along the sheet travel direction of the recording paper P. Among the multiple detection positions, the controller 300 that serves as the position deviation determining unit compares two detection positions of the side edge Pe and determines whether or not an amount of difference of the two detection positions exceeds a given amount.

Then, the image forming operation with respect to the recording paper P is performed according to the result obtained by the controller 300 based on the third detection position P3 as a position within the dog ear region and the second detection position P2 as a position outside the dog ear region.

At this time, an amount of variation ΔX of the detection result of the side edge Pe of the recording paper P obtained at the third detection position P3 and the detection result of the side edge Pe obtained at the second detection position P2 exceeds or is greater than a given amount, it is determined that the dog ear 201 produced on the recording paper P may need to be adjusted or the recording paper P having the dog ear 201 may be removed.

In the copier 100 according to example embodiments, the given amount of variation ΔX may be set to approximately 10 mm. When the amount of variation ΔX of the detection results of the side edge Pe of the third detection position P3 and the side edge Pe of the second detection position P2 is greater than 10 mm, it is determined that a complex paper jam may possibly be caused during the transfer operation. As a result, the transfer operation for image forming may be stopped to prevent an occurrence of a paper jam imposing a great load on a user for removing a complex jammed paper.

For a duplex or two-sided printing, the recording paper P may pass the detection positions of the sheet width sensor 101 for printing an image on the front side once, and pass again for printing an image on the back side thereof. In example embodiments, as shown in FIG. 11, the dog ear 201 may be produced at the corner of the trailing edge Pr of the recording paper P in the sheet travel direction. By detecting the dog ear 201 at the corner of the trailing edge Pr of the recording paper P, a paper jam or other failure due to the dog ear 201 may be reduced or prevented.

Further, similar to the detection of the dog ear 201 produced at the corner of the leading edge Pt of the recording paper P as shown in FIG. 10, the dog ear 201 produced at the corner of the trailing edge Pr of the recording paper P may be detected by detecting two detecting positions residing within an interval or length ΔL including the trailing edge Pr, as shown in a graph of FIG. 12.

In example embodiments, the sheet width sensor 101 serving as the end position detector is disposed at an upstream side of the pair of registration rollers 23 in the sheet travel direction of the recording paper P, where the pair of registration rollers 23 is disposed upstream of the transfer nip contact 50 that corresponds to the image forming position in the sheet travel direction of the recording paper P. At this position, the sheet width sensor 101 may detect the recording paper P having the dog ear 201 thereon.

In a case in which the transfer operation of the recording paper P is stopped by detecting the recording paper P having the dog ear 201, an image forming operation for forming an image on the recording paper P with the dog ear 201 thereon may be suspended or avoided.

Further, by detecting the dog ear 201 at the upstream side of the transfer nip contact 50 in the sheet travel direction of the recording paper P, the dog ear 201 formed on the recording paper P may be detected at a relatively early stage even through the transfer operation of the recording paper P may not be stopped before the image is formed on the recording paper P. Therefore, an occurrence of a paper jam may be reduced or prevented.

As described above, the sheet width sensor 101 that may detect the dog ear 201 may be disposed to the upstream side of the pair of registration rollers 23 in the sheet travel direction of the recording paper P.

However, as an alternative arrangement, the sheet width sensor 101 or a unit having a configuration to detect a dog ear 201 on a recording paper P may be set to any optional position in the sheet conveying path Pa. For example, the sheet width sensor 101 or a unit that may detect a dog ear 201 on a recording paper P may be disposed at a downstream side of the fixing unit 52 in the sheet travel direction. By detecting the dog ear 201 at the downstream side of the fixing unit 52 in the sheet travel direction, a dog ear 201 that is not formed on the recording paper P before the image forming operation but formed during the image forming operation may be detected.

Even though the recording paper P has the dog ear 201 thereon, it is less common to cause a failure when the recording paper P passing the fixing unit 52 is discharged to the sheet discharging unit 4 immediately after the fixing unit 52.

However, when the copier 100 performs the duplex printing with respect to the recording paper P with the dog ear 201 thereon, a failure such as a paper jam may be caused when performing the image forming operation on the back side of the recording paper P. Therefore, it may be more effective to detect the dog ear 201 formed on the recording paper P before starting the image forming operation on the back side of the recording paper P.

Further, there may be a case in which a folding operation or a binding operation is performed to the recording paper P after the image forming operation with respect to the recording paper P has been completed. In such a case, it may be useful to perform a complex transfer operation control with respect to the recording paper P after the completion of the image forming operation. This may be a cause of an occurrence of a paper jam when the recording paper P has the dog ear 201 thereon. Therefore, it may also be more effective for such an image forming apparatus to determine whether or not the recording paper P after passing the fixing unit 52 has the dog ear 201 thereon.

According to above-described example embodiments, the transfer operation of the recording paper P may be stopped when the amount of variation ΔX obtained based on the detection results of the side edge Pe at two detection positions in the vicinity of the leading edge Pt or the trailing edge Pr of the recording paper P exceeds or is greater than 10 mm, which is a given amount of variation. However, the copier 100 may take another action instead of the above-described stoppage of the transfer operation when the amount of variation ΔX between the detection results at the two positions is determined to be greater than the given amount.

Figure 13:
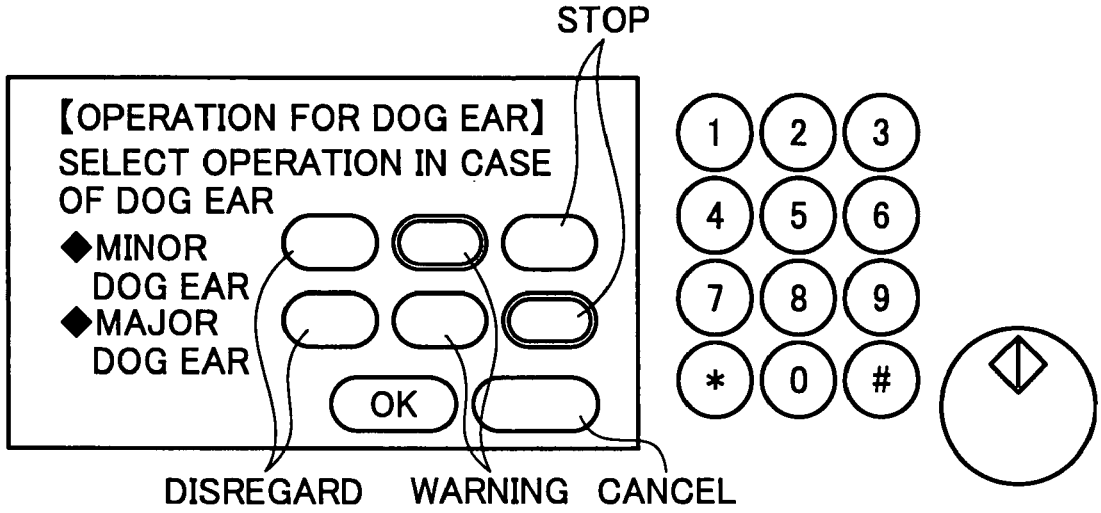
FIG. 13 is an example layout of an operation panel to be used for setting operation modes to execute when a dog ear has occurred, according to an example embodiment of the present patent application.
Figure 14:
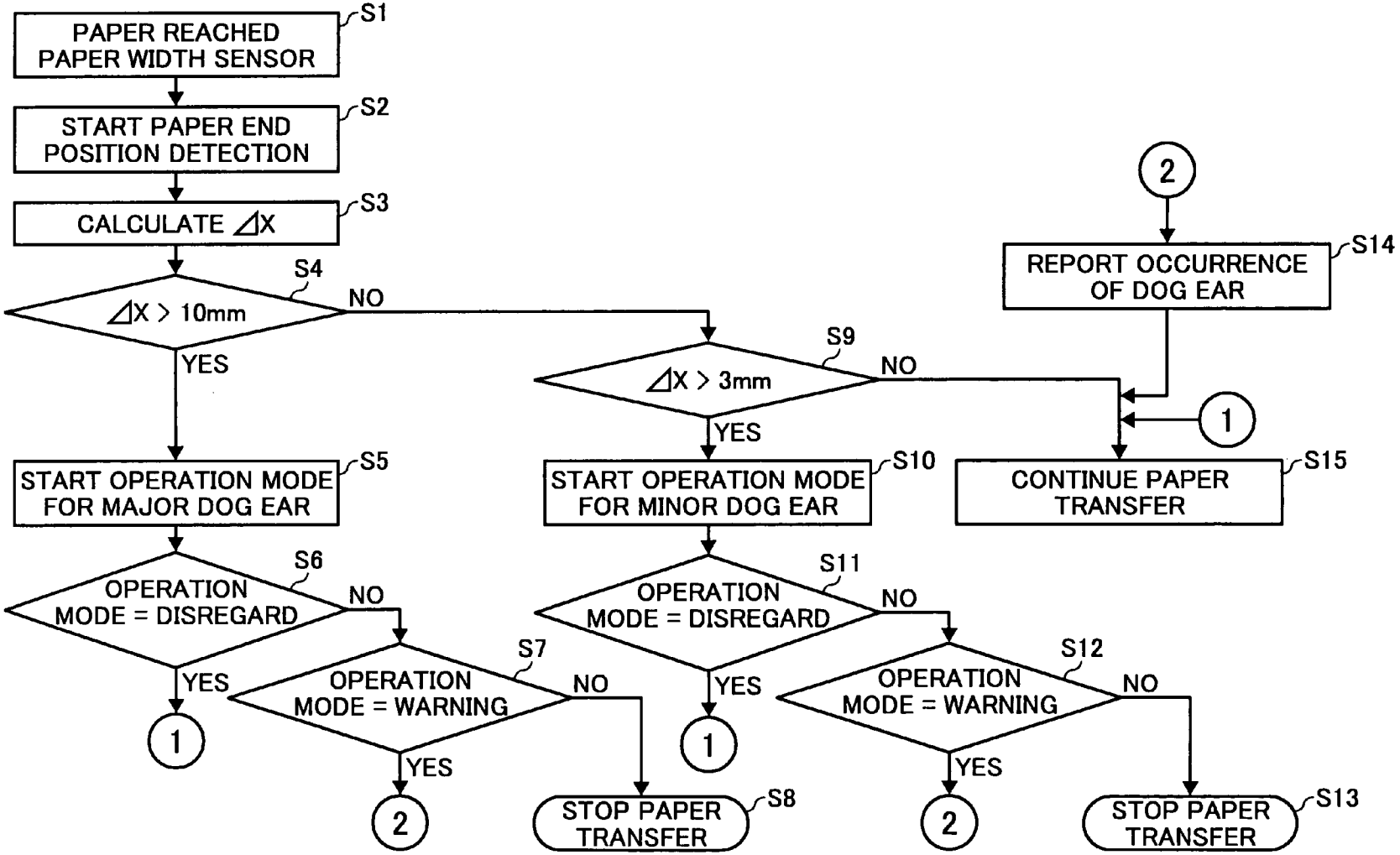
FIG. 14 is a flowchart showing a procedure to take when the dog ear is detected, according to an example embodiment of the present patent application.

Referring to FIGS. 13 and 14, a configuration in which a different operation is performed based on a specific operation mode previously set by a user to take a measure against the dog ear 201 is described according to example embodiments of the present patent application.

For example, a user who does not care about a dog ear 201 may select a mode to continue the operation. By contrast, a different user who wishes to strictly remove a dog ear 201 may select a mode to stop the transfer operation of the recording paper P. In addition, when a user wishes to know whether the dog ear 201 formed on the recording paper P gives a great impact or not, the user may select a mode to execute a warning only.

FIG. 13 shows a layout of an operation panel to be used for setting operation modes to take at the occurrence of the dog ear 201.

Similar to the above-described example embodiments, when the amount of variation ΔX of the detection results at the two specific positions exceeds or is greater than the given amount, which may be 10 mm in the present patent application, a user may select an operation mode from a "major dog ear" category. When the amount of variation ΔX is equal to or smaller than the given amount, a user may select an operation mode from a "minor dog ear" category.

FIG. 14 is a flowchart showing a procedure to take when the dog ear 201 is detected.

In the flowchart of FIG. 14, the controller 300 determines that the recording paper P has reached the sheet width sensor 101 at S1, and starts to detect the position of the side edge Pe of the recording paper P at S2.

Then, the controller 300 calculates the amount of variation ΔX of the detection results of the side edge Pe at two positions at S3, and compares the amount of variation ΔX with a given amount, which may be 10 mm, to determine whether or not the amount of variation ΔX exceeds or is greater than 10 mm at S4.

When the amount of variation ΔX is greater than 10 mm, the result of S4 is YES, and the process proceeds to S5 to enter to an operation mode for handling the major dog ear 201.

When the amount of variation ΔX is equal to or smaller than 10 mm, the result of S4 is NO, and the process proceeds to S9.

At S5, the controller 300 starts the operation mode for the major dog ear 201. After S5, the process proceeds to S6.

At S6, the controller 300 determines whether or not the operation mode is set to "DISREGARD."

When the operation mode is set to "DISREGARD", the result of S6 is YES, and the process proceeds to S15 to continue the transfer operation of the recording paper P.

When the operation mode is not set to "DISREGARD", the result of S6 is NO, and the process proceeds to S7.

At S7, the controller 300 determines whether or not the operation mode is set to "WARNING."

When the operation mode is set to "WARNING", the result of S7 is YES, and the process proceeds to S14 to display a message on the operation panel to report a user about an occurrence of a dog ear 201. Then, the process proceeds to S15 to continue the transfer operation of the recording paper P.

When the operation mode is not set to "WARNING", the result of S7 is NO, and the process proceeds to S8 to stop the transfer operation.

At S9, the controller 300 further compares the amount of variation ΔX with a given lower limit value to determine whether the amount of variation ΔX exceeds or is greater than the given lower limit value in S9. The lower limit value corresponds to a value or degree of a dog ear 201 that is acceptable to unspecified majority of users. In the present patent application, the lower limit value is set to 3 mm, for example.

When the amount of variation ΔX is greater than 3 mm, the result of S9 is YES, and the process proceeds to S10 to enter to an operation mode for handling the minor dog ear 201.

When the amount of variation ΔX is equal to or smaller than 3 mm, the result of S9 is NO, and the process proceeds to S15 to continue the transfer operation of the recording paper P.

After "YES" at S10, the controller 300 determines whether or not the operation mode is set to "DISREGARD" at S11.

When the operation mode is set to "DISREGARD", the result of S11 is YES, and the process proceeds to S15 to continue the transfer operation of the recording paper P.

When the operation mode is not set to "DISREGARD", the result of S11 is NO, and the process proceeds to S12.

At S12, the controller 300 determines whether or not the operation mode is set to "WARNING."

When the operation mode is set to "WARNING", the result of S12 is YES, and the process proceeds to S14 to display a message on the operation panel to report a user about an occurrence of a dog ear 201. Then, the process proceeds to S15 to continue the transfer operation of the recording paper P.

When the operation mode is not set to "WARNING", the result of S12 is NO, and the process proceeds to S13 to stop the transfer operation.

In the flowchart of FIG. 14, when the controller 300 serving as a position deviation determining unit determines that the amount of variation obtained based on the detection results of the side edge Pe at two positions in the vicinity of the leading edge Pt or the trailing edge Pr of the recording paper P is equal to or smaller than a given amount, which may be 10 mm, the controller 300 performs a first operation. By contrast, when the controller 300 determines that the amount of variation is greater than 10 mm, the controller 300 performs a second operation.

For example, under a condition that the operation mode at ΔX>10 mm is set to "STOP" and the operation mode at ΔX>3 mm is set to "DISREGARD", when the amount of variation ΔX is smaller than 10 mm and greater than 3 mm, a continuation operation to continue the image forming operation may be performed as the first operation. On the other hand, when the amount of variation ΔX is greater than 10 mm, a stop operation to stop the transfer operation of the recording paper P may be conducted as the second operation.

Further, under a condition that the operation mode at ΔX>10 mm is set to "STOP" and the operation mode at ΔX>3 mm is set to "WARNING", when the amount of variation ΔX is smaller than 10 mm and greater than 3 mm, a notification operation to notify a user of the results determined by the controller 300 serving as a position deviation determining unit may be performed as the first operation by displaying the message informing the occurrence of a dog ear 201 on the recording paper P. On the other hand, when the amount of variation ΔX is greater than 10 mm, the stop operation may be conducted as the second operation.

Furthermore, under a condition that the operation mode at ΔX>10 mm is set to "WARNING" and the operation mode at ΔX>3 mm is set to "DISREGARD", when the amount of variation ΔX is smaller than 10 mm and greater than 3 mm, the continuation operation may be performed as the first operation. On the other hand, when the amount of variation ΔX is greater than 10 mm, the notification operation may be performed as the first operation by displaying the message informing the occurrence of a dog ear 201 on the recording paper P.

According to the above-described example embodiments of the present patent application, the sheet width sensor 101 serving as an end position detector may be disposed to detect only one end of the recording paper P.

However, the present patent application is not limited to the setting of the sheet width sensor 101 to detect one end of the recording paper P only. For example, the present patent application is applicable to a sheet width sensor to detect both ends of the recording paper P.

Figure 15:
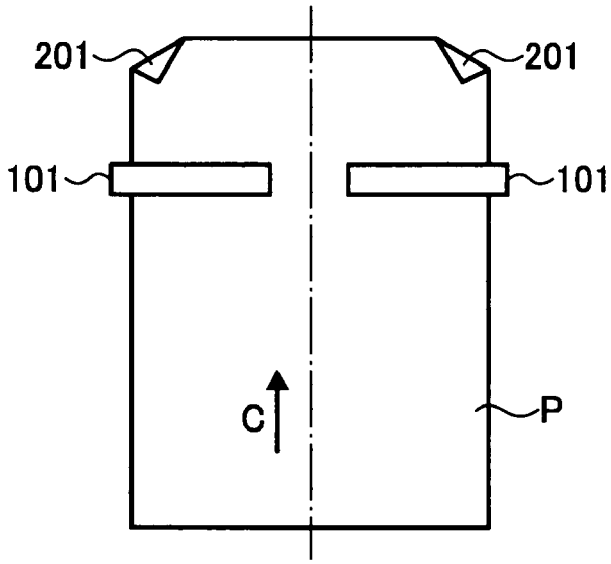
FIG. 15 is a view of two sheet width sensors disposed on both sides of the recording medium according to an example embodiment of the present patent application.

Referring to FIG. 15, an illustration of two sheet width sensors 101 disposed on both sides of the recording paper P is shown according to example embodiments of the present patent application. The sheet width sensors 101 according to example embodiments of the present patent application may detect respective side edges Pe of the recording paper P, thereby providing higher detection ability of the dog ear.

According to example embodiments of the present patent application, two sheet width sensors 101 are disposed to detect both side edges Pe of the recording paper P. However, a sheet width sensor 101 to detect both side edges Pe of the recording paper P in the present patent application is not limited to the above-described two sheet width sensors 101. For example, the present patent application is applicable to one sheet width sensor 101 to detect both sides of the recording paper P.

Figure 16:
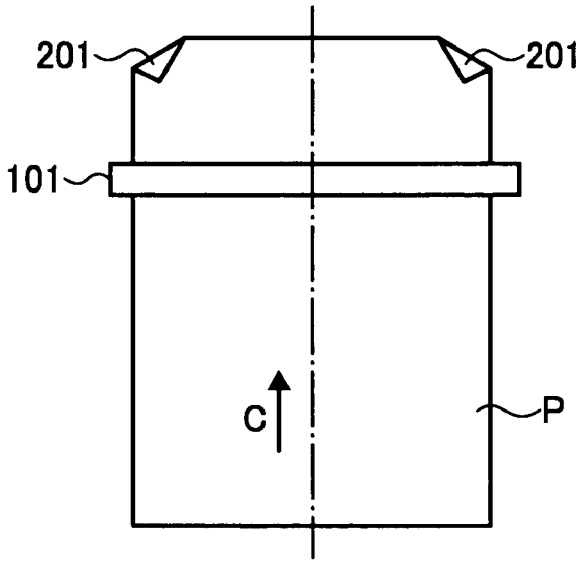
FIG. 16 is a view of a single sheet width sensor having a widthwide length corresponding to the entire width of a recording medium according to an example embodiment of the present patent application.

Referring to FIG. 16, an illustration of one sheet width sensor 101 having a widthwide length corresponding to the entire width of the recording paper P is shown according to example embodiments of the present patent application. Similar to the sheet width sensor 101 described above, the sheet width sensor 101 according to example embodiments of the present patent application may detect respective side edges Pe of the recording paper P, thereby providing higher detection likelihood of the dog ear.

By providing the sheet width sensors 101 according to example embodiments and the sheet width sensor 101 according to example embodiments to the copier 100, both side edges Pe of the recording paper P may be detected, and therefore, dog ears 201 formed at both corners of the recording paper P may effectively be detected.

However, when a recording paper position detection unit originally used to adjust and/or correct the positional deviation is used as a detection unit to detect dog ears 201, the copier 100 serving as an image forming apparatus may avoid failures such as a paper jam without an increase in costs.

When the sheet width sensor 101 that may detect the position of the side edge Pe in the sheet width direction, the sheet width sensor 101 may detect a deviation of the recording paper P along the side edge Pe in the sheet width direction and a skew of the recording paper P at an angle in the skew direction. That is, the sheet width sensor 101 detects the above-described deviation or skew and transmits the detection results to the controller 300 serving as an end position detector. Based on the detection results, the controller 300 recognizes the deviation or skews. The results of recognition by the controller 300 may be used for a skew detection process serving as a recording medium inclination detection to detect a degree of inclination of the recording paper P with respect to the recording paper P in the sheet travel direction.

Referring to FIGS. 17A, 17B, 18A, and 18B, a description is given of a recording paper P having a skew when passing the detection position of the sheet width sensor 101.

Figure 17A:
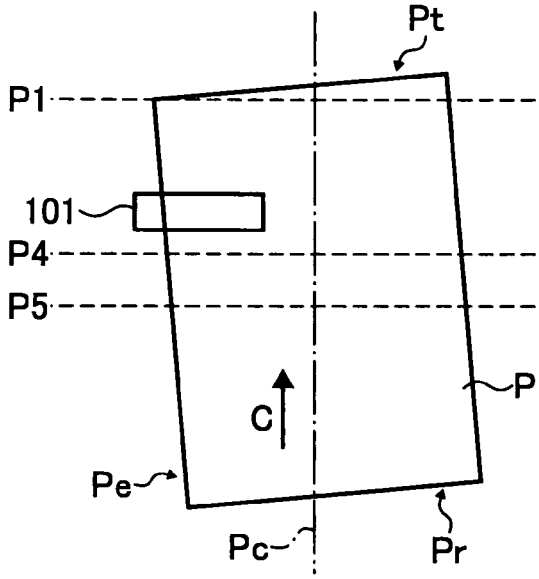
FIG. 17A is an example recording paper passing the sheet width sensor, the recording paper having a skew.
Figure 17B:
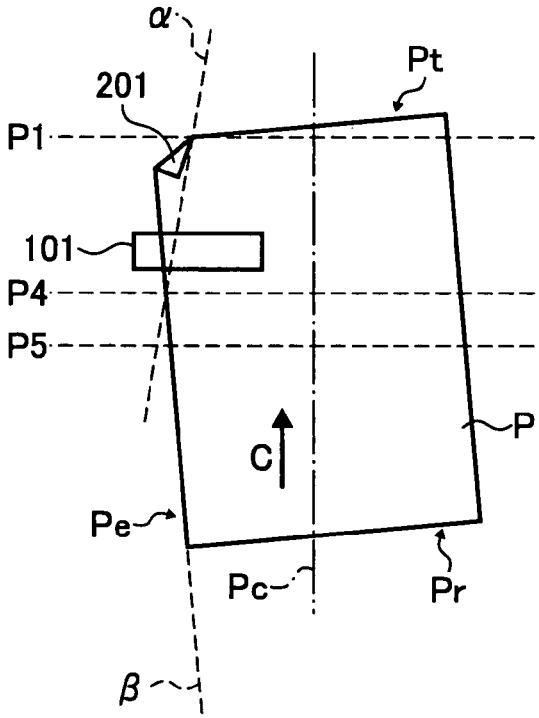
FIG. 17B is an example recording paper passing the sheet width sensor, the recording paper having a skew and a dog ear.
Figure 18A:
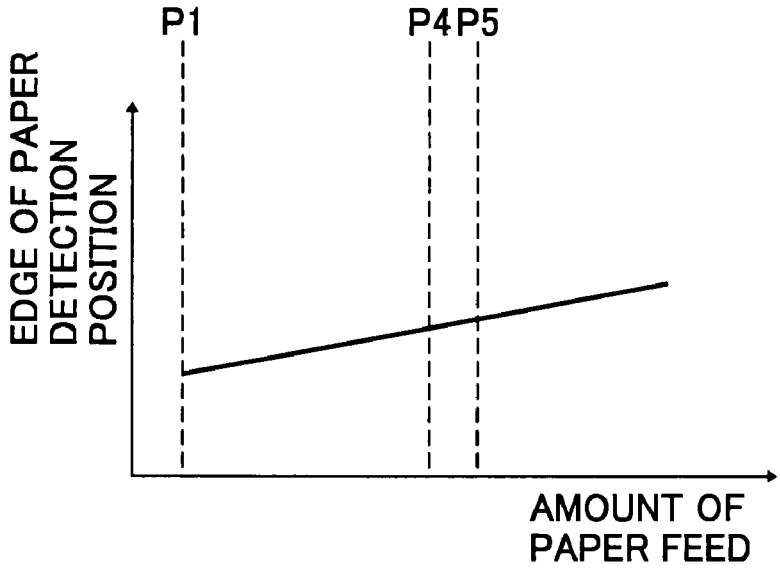
FIG. 18A is an example graph showing detection results of the recording paper of FIG. 17A.
Figure 18B:
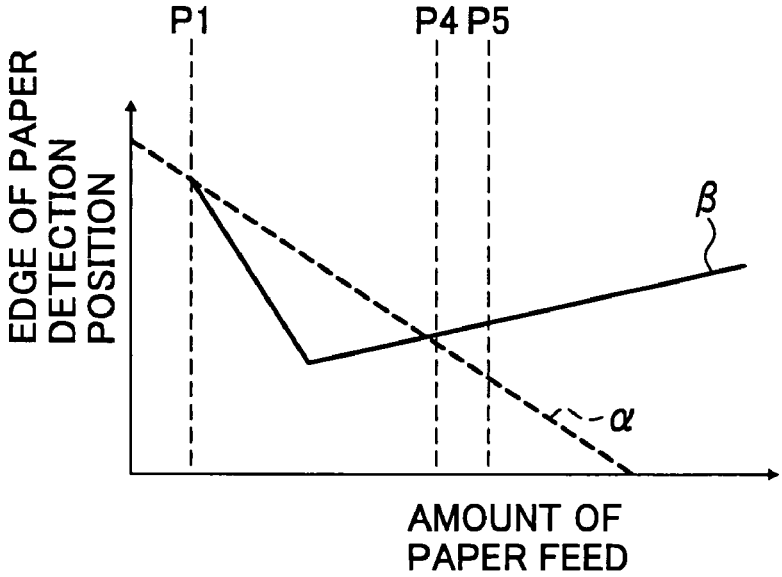
FIG. 18B is an example graph showing detection results of the recording paper of FIG. 17B.

FIG. 17A shows an inclined recording paper P having a skew, and FIG. 17B shows an inclined recording paper P having a skew and a dog ear 201 at the corner of the recording paper P. FIG. 18A is a graph showing detection results obtained by sequentially detecting the side edge Pe of the recording paper P having a skew as shown in FIG. 17A. FIG. 18B is a graph showing detection results obtained by sequentially detecting the side edge Pe of the recording paper P having a skew and a dog ear 201 as shown in 17B.

To detect a skew, the side edge Pe may be detected at two detection positions located in the vicinity of the center of the recording paper P in the sheet travel direction. In FIGS. 17A and 17B, the two detection positions are a first skew detection position P4 and a second skew detection position P5. After the respective side edges Pe of the recording paper P have been detected at the first skew detection position P4 and the second skew detection position P5, the skew may be detected based on the detection results of the side edge Pe of the recording paper P.

By detecting the side edges Pe at two detection positions in the vicinity of the center of the recording paper P in the sheet travel direction, the two detection positions detecting the skew may detect the side edge Pe without being affected by dog ear 201, as shown in FIGS. 17B and 18B, even when the dog ear 201 is formed at the leading edge Pt of the recording paper P. In addition, even with the dog ear 201 is formed at the trailing edge Pr of the recording paper P, the side edge Pe of the recording paper P may be detected at the first skew detection position P4 and the second skew detection position P5 without being affected by dog ear 201.

When the first skew detection position P4 and the second skew detection position P5 are located relatively close to each other, it may be difficult to find a difference of the detection results thereof. Therefore, it may be advantageous that the first skew detection position P4 and the second skew detection position P5 are located in the sheet travel direction of the recording paper P, with an appropriate distance of range to which an adverse affect does not exert even when a dog ear 201 is formed on the recording paper P.

The existence of skew may be determined by comparing the detection results of the first skew detection position P4 and the second skew detection position P5 to determine whether there is any difference or variation therebetween. The degree or amount of the skew, which is a degree of inclination of the recording paper P, may be determined based on an amount of variation $\Delta X$ in the detection results of the first skew detection position P4 and the second skew detection position P5 and an amount or distance of paper feed from the first skew detection position P4 to the second skew detection position P5.

When the degree or amount of skew is detected, the image forming position on the recording paper P may be corrected by following the procedure as described below.

Image data of an image to be formed on the recording paper P having a skew is converted to another image data including an image adjusted and turned to match with an angle of skew detected by the image processing unit, not shown. Based on an image signal of the image data of adjusted image, the laser diode LD, not shown, in the optical writing unit 7 emits laser light beams to irradiate the surface of the photoconductive drum 61 so as to form an electrostatic latent image on the surface thereof. The developing unit 63 develops the electrostatic latent image to a toner image. The toner image is then transferred onto the recording paper P. With the above-described action, an image forming position on a skewed recording paper P on which a toner image is to be formed may be corrected so that the toner image may be formed on a proper position without being affected by the inclination of the recording paper P.

A method to convert image data to another image data adjusted and turned to a skew may be a conventional method. For example, a conventional method in which image data of original image or source image is read per block having a given size, then the inverse affin transform is executed in each block to correct the skew may be employed.

Next, a description is given of a configuration in which a dog ear 201 is detected based on edge-to-edge lines, according to example embodiments of the present patent application.

Here, a line connecting a point on an optional side edge Pe detected at one detection position and a point on another optional side edge Pe detected at a different detection position, among three or more detection positions in the sheet travel direction of the recording paper P, is defined and referred to as an "edge-to-edge line". The edge-to-edge line is calculated and obtained based on respective positions of the two optional side edges Pe of a recording paper P and an amount of feed between the two optional side edges Pe.

When no dog ear 201 is formed on the recording paper P, the side edges Pe of the respective detection positions reside on a same line. Therefore, an inclination of an edge-to-edge line is constantly same when two optional side edges Pe of the recording paper P reside on any detection positions of the recording paper P in the sheet travel direction.

In reference to FIG. 17A, an edge-to-edge line connecting a point on a side edge Pe detected at the first detection position P1 and a point on another side edge Pe detected at the first skew detection position P4 matches with a line corresponding to the side edge Pe of the recording paper P, and the line has the same degree of inclination as the edge-to-edge line. Similarly, an edge-to-edge line connecting a point on a side edge Pe detected at the first skew detection position P4 and a point on another side edge Pe detected at the second skew detection position P5 matches with the above-described line corresponding to the side edge Pe of the recording paper P.

Similar to the edge-to-edge line, the inclination of an edge-to-edge line is calculated and obtained based on respective positions of the two optional side edges Pe of the recording paper P and an amount of feed between the two optional side edges Pe thereof.

When no dog ear 201 is formed on the recording paper P as shown in FIG. 17A, the inclination of an edge-to-edge line is constantly same as the inclination of the line of the side edge Pe as shown in the graph of FIG. 18A.

By contrast, when a dog ear 201 is formed on the recording paper P, the edge-to-edge line connecting two optional side edges Pe detected at different detection positions of the recording paper P is not on the same line as the line of the side edge Pe of the recording paper P. In other words, the edge-to-edge line of the side edges Pe of the recording paper P having a dog ear 201 may not be straight but bent in the middle, and the inclination of the edge-to-edge line may change depending on whether at least one of the two optional side edges Pe resides in a region with a dog ear 201 formed therein.

In FIG. 17B, for example, the inclination of an edge-to-edge line connecting a point on a side edge Pe detected at the first detection position P1 and a point on another side edge Pe detected at the first skew detection position P4 is different from the inclination of an edge-to-edge line connecting a point on a side edge Pe detected at the first skew detection position P4 and a point on another side edge Pe detected at the second skew detection position P5. For example, the edge-to-edge line connecting the point on the side edge Pe detected at the first detection position P1 and the point on the side edge Pe detected at the first skew detection position P4 corresponds to a straight line α in FIG. 17B and the edge-to-edge line connecting the point on the side edge Pe detected at the first skew detection position P4 and the point on the side edge Pe detected at the second skew detection position P5 corresponds to a straight line β. Therefore, as shown in FIG. 18B, the inclinations of these two edge-to-edge lines are different.

As described above, when the recording paper P has a dog ear 201 thereon, the controller 300 may detect the side edges Pe of the recording paper P at three or more detection positions in the sheet travel direction thereof and calculates the degree of inclination of the edge-to-edge line connecting two optional side edges Pe among the above-described detection positions of the recording paper P. As a result, the inclination of the edge-to-edge line connecting one combination of the optional side edges Pe and the inclination of the edge-to-edge line connecting another combination of the optional side edges Pe may be different.

Next, a detailed description is given of the detection of a dog ear 201 on the recording paper P based on the different inclinations of two edge-to-edge lines, according to example embodiments of the present patent application.

In example embodiments, the controller 300 may serve as an inclination calculator and an inclination deviation determining unit. That is, the controller 300 performing a function of an inclination calculator calculates an inclination of an edge-to-edge line connecting two optional side edges Pe of the recording paper P, and the controller 300 performing a function of an inclination deviation determining unit determines whether or not respective inclinations of the two edge-to-edge lines are different.

The inclinations of the straight lines α and β in FIG. 18B may be calculated by the controller 300 serving as the inclination calculator. Further, the controller 300 serving as the inclination deviation determining unit may determine whether the inclination of an edge-to-edge line or the straight line α obtained based on one combination of two optional side edges Pe is different from the inclination of another edge-to-edge line or the straight line β obtained based on another combination of two optional side edges Pe. Therefore, when a dog ear 201 is formed on the recording paper P, the inclinations of different edge-to-edge lines may differ depending on a combination of two optional side edges Pe of the recording paper P, such as the straight lines α and β shown in FIG. 18B. Accordingly, the recording paper P having a dog ear 201 may effectively be detected based on the inclinations of different edge-to-edge lines.

According to the inclination deviation determining unit, which may be a function of the controller 300, the inclinations of the straight lines α and β as shown in FIG. 18B, for example, are determined to be different, thereby detecting a dog ear 201 formed on the recording paper P. In example embodiments, the transfer operation of the recording paper P for the image forming operation may be stopped, and therefore, a user may remove a paper jammed in a complex manner.

In the above-described example embodiments of the present patent application, the recording paper P having a dog ear 201 is detected by comparing two positions of the side edges Pe of the recording paper P. However, even through such a comparison of two positions of the side edges Pe is conducted, it may be difficult to distinguish the recording paper P having a dog ear 201 from causing misregistration due to skew. By contrast, the determination of whether or not two edge-to-edge lines have different inclinations is made based on the two positions of the side edges Pe of different combinations, according to example embodiments. Accordingly, it may further surely be distinguished or determined whether the difference of the two positions of the side edges Pe is caused by a dog ear 201 or misregistration due to skew. If the inclination of two edge-to-edge lines of the two different combinations of the side edges Pe of the recording paper P is caused by misregistration due to skew, the side edges Pe of the detection positions of the recording paper P may reside on the same line.

Also in example embodiments, one of the multiple detection positions, which may be detected by the sheet width sensor 101 and recognized by the controller 300, may be adjusted and specified to the first detection position P1 located within the dog ear region in the vicinity of the leading edge Pt of the recording paper P in the sheet travel direction. Accordingly, may be more reliably detected and confirmed that the dog ear 201 has occurred at the leading edge Pt of the recording paper P.

The configuration according to example embodiments of the present patent application is also applicable to the functions of the controller 300 to compare two optional side edges Pe described in example embodiments, to determine whether a difference of the detection results of the two optional side edges Pe of the recording paper P, and to control the transfer operation of the recording paper P based on the detection results.

In example embodiments, when the controller 300 serving as an inclination deviation determining unit determines that the inclination of an edge-to-edge line connecting a combination of two optional side edges Pe of the recording paper P is different from the inclination of a different edge-to-edge line connecting a different combination of two optional side edges Pe of the recording paper P, the same control may be executed as when a dog ear 201 has been formed on the recording paper P in the above-described example embodiment, based on the determination results of the controller 300 serving as a positional deviation determining unit.

As described above, the configuration according to the above-described example embodiments of the present patent application may be provided to or mounted on a sheet conveying path of an image forming apparatus. However, the above-described configuration of the present patent application is not limited to an image forming apparatus but may also be applied to a sheet conveying device for conveying a recording medium therein.

When the above-described configuration is applied to a sheet conveying device, an end position detector is disposed in a sheet conveying path provided in the sheet conveying device and a controller having functions of a position deviation determining unit, an inclination calculator, an inclination deviation determining unit, and so forth is provided in the sheet conveying device.

The sheet conveying device may be integrally mounted on an image forming apparatus or be provided as an optional sheet feeding device that may be optionally added to an image forming apparatus. Alternatively, the sheet conveying device may have a configuration in which a recording medium discharged from an image forming apparatus is reversed therein to be conveyed back to the image forming apparatus for image forming in the duplex mode, for example.

According to above-described example embodiments of the present patent application, the controller 300 serving as an end position recognizer may recognize the position of the side edge Pe detected at the multiple detection positions, based on the detection results of the sheet width sensor 101 serving as an end position detector. The multiple detection positions includes the first detection position P1, which is a position in the dog ear region located in the vicinity of the leading edge Pt in the sheet travel direction of the recording paper P serving as a recording medium. The first detection position P1 is located at which a dog ear 201 is possibly formed and the second detection position P2 is located at which a dog ear 201 is less formed than the first detection position P1. Therefore, the controller 300 may recognize that the side edge Pe detected at the first detection position P1 is located to a more medial side of or closer to the center Pc of the recording paper P than the side edge Pe detected at the second detection position P2, along the sheet width direction. That is, when comparing an optional position located within a dog ear region with another optional position located out of the dog ear region, the position of the side edge Pe detected at the first detection position P1 is medially located in the sheet width direction of the recording paper P. Therefore, by detecting that the side edge Pe at the first detection position P1 is medially located to the center Pc of the recording paper P in the sheet width direction of the recording paper P more than the side edge Pe detected at the second detection position P2, it may be detected that the recording paper P has a dog ear 201 at the leading edge Pt thereof.

Further, the controller 300 may recognize the side edge Pe at multiple detection positions based on the detection results obtained by the sheet width sensor 101, obtain an amount of variation ΔX that indicates a difference of the results of recognition of the side edge Pe detected at the first detection position P1 and the side edge Pe detected at the second detection position P2, which are two detection positions among the multiple detection positions, and determine whether the amount of variation ΔX is greater than a given amount, which may be 10 mm. Then, the image forming operation with respect to the recording paper P is performed according to the result obtained by the controller 300 serving the position deviation determining unit in reference to the first detection position P1 as one position within the dog ear region and the second detection position P2 as one position outside the dog ear region. For example, when the amount of variation ΔX is greater than 10 mm, it is determined that a complex paper jam is possibly be caused during the transfer operation, and therefore, the transfer operation for image forming may be stopped.

Further, based on the detection results of the sheet width sensor 101, the controller 300 may recognize the side edge Pe of the recording paper P, which is detected at the multiple detection positions in the sheet travel direction. At least one of the multiple detection positions may be located outside the dog ear region. For example, the second detection position P2 that is compared with the first detection position P1 regarding the position of the side edge Pe is located outside the dog ear region. Therefore, the position of the side edge Pe detected at the first detection position P1 on which the dog ear 201 is formed and the position of the side edge Pe detected at the second detection position P2 on which no dog ear 201 is formed may be compared, thereby detecting the degree of the dog ear 201 more accurately.

Further, when the controller 300 serving as a position deviation determining unit determines that the amount of variation ΔX obtained based on the detection results of the side edge Pe detected at the first detection position P1 and the side edge Pe detected at the second detection position P2 is equal to or smaller than a given amount, which may be 10 mm, the controller 300 may perform a first operation. By contrast, when the controller 300 determines that the amount of variation is greater than 10 mm, the controller 300 may perform a second operation. Accordingly, the controller 300 may perform an appropriate operation according to the degree of the dog ear 201.

Further, when the degree or size of the dog ear 201 is small, the controller 300 may enter the "DISREGARD" mode to execute the continuation operation as the first operation to continue the current image forming operation. With this operation, when the dog ear 201 exceeding the acceptable range is formed on the recording paper P, the image forming operation may continue, thereby maintaining the image productivity.

On the other hand, when the degree or size of the dog ear 201 is great, the controller 300 may enter the "STOP" mode to execute the stop operation as the second operation to stop the transfer operation of the recording paper P. With this operation, an occurrence of a complex paper jam may be avoided.

Further, when the degree or size of the dog ear 201 is small, the controller 300 may enter the "WARNING" mode to execute the notification operation as the first operation to notify a user of the results determined by the controller 300 serving as a positional deviation determination unit. By notifying a user of the results, the user may learn the current status of the transfer operation in the copier 100.

On the other hand, when the degree or size of the dog ear 201 is great, the controller 300 may enter the "STOP" mode to execute the stop operation as the second operation to stop the transfer operation of the recording paper P. With this operation, an occurrence of a complex paper jam may be avoided.

Further, when the degree or size of the dog ear 201 is small, the controller 300 may enter the "DISREGARD" mode to execute the continuation operation as the first operation to continue the current image forming operation. With this operation, the image forming operation may continue, thereby maintaining the image productivity.

On the other hand, when the degree or size of the dog ear 201 is great, the controller 300 may enter the "WARNING" mode to execute the notification operation as the second operation to notify a user of the results determined by the controller 300 so that the user may learn the current status of the transfer operation in the copier 100 and the image productivity may be maintained.

Further, the sheet width sensor 101 (for example, the transmission-type sheet width sensor 101*t*, the reflection-type sheet width sensor 101*r*, etc.) may be a line sensor and include the light emitting part 102 (for example, the light emitting part 102*t*, the light emitting part 102*r*, etc.) and the light receiving part 103 (for example, the light receiving part 103*t*, the light receiving part 103*r*, etc.). The light emitting part 102 includes at least one light emitting element 102*a* (for example, the light emitting element 102*ta*, the multiple light emitting elements 102*ra*, etc.), and the light receiving part 103 includes the multiple light receiving elements 103*a* (for example, the multiple light receiving elements 103*ta*, the multiple light receiving elements 103*ra*, etc.) aligned in an array in the sheet width direction. With the above-described configuration, the sheet width sensor 101 may effectively detect the side edge Pe of the recording paper P.

Further, the sheet width sensor 101 is fixedly disposed in the sheet conveying path Pa. While the recording paper P travels in the sheet conveying path Pa, the sheet width sensor 101 may detect the side edge Pe of the recording paper P at multiple detection positions when the recording paper P passes through the sheet width direction 101. Therefore, since the side edge Pe at the multiple detection positions in the sheet travel direction of the recording paper P may be detected with a single sheet width sensor 101, multiple sheet width sensors may not need to be provided to the copier 100, thereby contributing a reduction of costs.

Further, by disposing the sheet width sensor 101 upstream of the pair of registration rollers 23 serving as a registration part along the sheet travel direction of the recording paper P, a dog ear 201 may be found in the early stage, and therefore, an occurrence of a paper jam may effectively be reduced or prevented.

Further, as shown in example embodiments, by determining whether two edge-to-edge lines have different inclinations obtained based on the two positions of the side edges Pe of different combinations, a further sure determination of whether the difference of the two positions of the side edges Pe is caused by a dog ear 201 or misregistration due to skew may be conducted.

Further, the configuration of the present patent application may be applied to a sheet conveying device so that a recording medium having a dog ear 201 thereon may be detected. Therefore, a same effect as the above-described example embodiments.

Further, the sheet conveying device having a recording medium accumulating mechanism to accumulate recording media therein may be used as a sheet feeding device.

Above-described example embodiments are illustrative, and numerous additional modifications and variations are possible in light of the above teachings. For example, elements and/or features of different illustrative and example embodiments herein may be combined with each other and/or substituted for each other within the scope of this disclosure and appended claims. It is therefore to be understood that within the scope of the appended claims, the disclosure of this patent specification may be practiced otherwise than as specifically described herein.

Example embodiments being thus described, it will be obvious that the same may be varied in many ways. Such variations are not to be regarded as a departure from the spirit and scope of the present patent application, and all such modifications as would be obvious to one skilled in the art are intended to be included within the scope of the following claims.

What is claimed is:

1. An image forming apparatus configured to convey a recording medium through a sheet conveying path to an image forming position and form an image on the recording medium, the image forming apparatus comprising:

an edge position detector to detect a position of a side edge of a recording medium along a width direction perpendicular to a sheet travel direction of the recording medium in the sheet conveying path; and a controller, the controller configured to recognize, based on detection results obtained by the edge position detector, the position of the side edge at multiple detection positions of the recording medium in the sheet travel direction of the recording medium, the multiple detection positions including a detection position located within a dog ear region in the vicinity of either a leading edge or a trailing edge of the recording medium in the sheet travel direction, the multiple detection positions including three or more detection positions, calculate an inclination of either a line connecting two or more points on side edges of the three or more detection positions or an edge-to-edge line obtained by approximating the side edge in the width direction of the two or more points, and determine whether inclinations of two edge-to-edge lines obtained based on the two or more points on the side edges of the recording medium in the width direction, the edge-to-edge lines having different combinations of the two or more points of the side edges in the width direction, are different.

2. The image forming apparatus according to claim 1, wherein the image forming operation with respect to the recording medium is controlled based on results obtained by the controller.

3. The image forming apparatus according to claim 1, wherein the controller is further configured to determine whether an amount of variation on results of the side edges detected at two detection positions is greater than a given amount, the two detection positions, among the multiple detection positions, being either of a first combination of one detection position located within the dog ear region and one detection position located outside the dog ear region or a second combination of two detection positions located within the dog ear region, the image forming operation with respect to the recording medium being controlled according to results obtained by the controller.

4. The image forming apparatus according to claim 3, wherein at least one of the multiple detection positions is located outside the dog ear region and the controller determines whether an amount of variation on results of the side edge detected at two detection positions corresponding to the first combination is greater than the given amount.

5. The image forming apparatus according to claim 3, wherein after the controller has determined the inclinations of the two edge-to-edge lines are different, a first operation is performed when the controller determines the amount of variation is equal to or smaller than the given amount and a second operation is performed when the controller determines the amount of variation is greater than the given amount.

6. The image forming apparatus according to claim 5, wherein the first operation includes a notification operation to notify a user of the results determined by the controller and the second operation includes a stop operation to stop a transfer operation of the recording medium.

7. The image forming apparatus according to claim 5, wherein the first operation includes a continuation operation to continue the image forming operation and the second operation includes a stop operation to stop a transfer operation of the recording medium.

8. The image forming apparatus according to claim 5, wherein the first operation includes a continuation operation to continue the image forming operation and the second operation includes a notification operation to notify a user of the results determined by the position deviation determining unit.

9. A recording medium conveying unit, comprising:

an edge position detector to detect a position of a side edge of a recording medium along a width direction perpendicular to a sheet travel direction of the recording medium in a sheet conveying path; and a controller configured to recognize, based on detection results obtained by the edge position detector, the position of the side edge at multiple detection positions of the recording medium in the sheet travel direction of the recording medium, and calculate an inclination of either a line connecting two or more points on side edges of three or more detection positions or an edge-to-edge line obtained by approximating the side edge in the width direction of the two or more points;

determine whether inclinations of two edge-to-edge lines obtained based on the two or more points on the side edges of the recording medium in the width direction, the edge-to-edge lines having different combinations of the two or more points of the side edges in the width direction;

and a sheet accumulating unit to accumulate the recording medium prior to the transfer operation.

10. An image forming apparatus configured to convey a recording medium through a sheet conveying path to an image forming position and form an image on the recording medium, the image forming apparatus comprising:

an edge position detector to detect a position of a side edge of a recording medium along a width direction perpendicular to a sheet travel direction of the recording medium in the sheet conveying path; and a controller configured to based on detection results obtained by the edge position detector, calculate an inclination of either a line connecting two or more points on side edges of the recording medium or an edge-to-edge line obtained by approximating an edge of the recording medium in a width direction using the two or more points, the two or more points corresponding to two or more detection positions from among multiple detection positions, the multiple detection positions including three or more detection positions, and determine whether inclinations of two edge-to-edge lines obtained based on the two or more points on the side edges of the recording medium in the width direction, the edge-to-edge lines having different combinations of the two or more points of the side edges in the width direction, are different.

11. The image forming apparatus according to claim 10, wherein the image forming operation with respect to the recording medium is controlled based on results obtained by the controller.

12. The image forming apparatus according to claim 10, wherein the three or more detection positions include a detection position located within a dog ear region in the vicinity of either a leading edge or a trailing edge in the sheet travel direction of the recording medium.

13. The image forming apparatus according to claim 10, wherein the controller is further configured to determine whether an amount of variation on results of the side edges detected at two detection positions is greater than a given amount, the two detection positions, among the multiple detection positions, being either of a first combination of one detection position located within the dog ear region and one detection position located outside the dog ear region or a second combination of two detection positions located within the dog ear region, the image forming operation with respect to the recording medium being controlled according to results obtained by the controller.

14. The image forming apparatus according to claim 13, wherein at least one of the multiple detection positions is located outside the dog ear region and the controller determines whether an amount of variation on results of the side edge detected at two detection positions corresponding to the first combination is greater than the given amount.

15. The image forming apparatus according to claim 13, wherein after the controller has determined the inclinations of the two edge-to-edge lines are different, a first operation is performed when the position deviation determining unit determines the amount of variation is equal to or smaller than the given amount and a second operation is performed when the controller determines the amount of variation is greater than the given amount.

16. The image forming apparatus according to claim 15, wherein the first operation includes a notification operation to notify a user of the results determined by controller and the second operation includes a stop operation to stop a transfer operation of the recording medium.

17. The image forming apparatus according to claim 15, wherein the first operation includes a continuation operation to continue the image forming operation and the second operation includes a stop operation to stop a transfer operation of the recording medium.

18. The image forming apparatus according to claim 15, wherein the first operation includes a continuation operation to continue the image forming operation and the second operation includes a notification operation to notify a user of the results determined by the controller.

19. The image forming apparatus according to claim 10, wherein the controller is further configured to recognize, based on detection results obtained by the edge position detector, the position of the side edge at multiple detection positions of the recording medium in the sheet travel direction of the recording medium.

* * * * *